US008444135B2

(12) United States Patent
Morita et al.

(10) Patent No.: US 8,444,135 B2
(45) Date of Patent: May 21, 2013

(54) SHEET CONVEYANCE DEVICE, AND IMAGE FORMING APPARATUS AND IMAGE READING UNIT INCLUDING SAME

(75) Inventors: Kenichiro Morita, Tokyo (JP); Hideki Tobinaga, Kanagawa (JP); Shinya Kitaoka, Kanagawa (JP); Mamoru Kambayashi, Tokyo (JP); Michitaka Suzuki, Kanagawa (JP); Atsushi Kanaya, Kanagawa (JP); Norio Kimura, Kanagawa (JP); Yoshito Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/293,164

(22) Filed: Nov. 10, 2011

(65) Prior Publication Data

US 2012/0119436 A1 May 17, 2012

(30) Foreign Application Priority Data

Nov. 11, 2010 (JP) ..... 2010-253051
Apr. 11, 2011 (JP) ..... 2011-086986

(51) Int. Cl.
*B65H 83/00* (2006.01)
*B65H 7/02* (2006.01)
*G03G 15/00* (2006.01)

(52) U.S. Cl.
USPC ..... 271/3.17; 271/265.01; 271/265.02; 399/371

(58) Field of Classification Search
USPC ..... 271/10.01–10.03, 265.01, 265.02, 271/3.06, 3.09, 3.13, 3.15, 3.17, 4.02, 4.03; 399/370, 371, 367
See application file for complete search history.

(56) References Cited

U.S. PATENT DOCUMENTS 6,151,478 A * 11/2000 Katsuta et al. ..... 399/372
6,585,258 B1 * 7/2003 Hirota et al. ..... 271/186

(Continued)

FOREIGN PATENT DOCUMENTS

JP 11079464 A 3/1999
JP 2002300345 A 10/2002

(Continued)

OTHER PUBLICATIONS

Abstract of JP 11-079464 published Mar. 23, 1999.

(Continued)

*Primary Examiner* — Kaitlin Joerger
*Assistant Examiner* — Patrick Cicchino
(74) *Attorney, Agent, or Firm* — Harness, Dickey & Pierce, P.L.C.

(57) ABSTRACT

A sheet conveyance device includes a loading section, a first conveyance member a separation section, a first sheet length detector to detect whether the sheet is longer than a predetermined length slightly longer than a specific sheet size in the sheet conveyance direction, a trailing-edge detector disposed downstream from the separation section, a leading-edge detector disposed downstream from the trailing-edge detector a distance smaller than the specific sheet size and from the first conveyance member a distance longer than the specific sheet size, and a controller. When the sheet is equal to or greater than the predetermined length, the controller starts sheet feeding when the trailing-edge detector detects the trailing edge of the sheet, and when the sheet is smaller than that, the controller starts sheet feeding when either the leading-edge detector detects the leading edge of the sheet or the trailing-edge detector detects the trailing edge thereof.

20 Claims, 18 Drawing Sheets

U.S. PATENT DOCUMENTS

| | | | | |
|---|---|---|---|---|
| 7,457,579 | B2 * | 11/2008 | Morimoto | 399/370 |
| 2010/0225045 | A1 * | 9/2010 | Kimura et al. | 271/4.08 |

FOREIGN PATENT DOCUMENTS

| | | | |
|---|---|---|---|
| JP | 2004083210 | A | 3/2004 |
| JP | 2005-324872 | A | 11/2005 |
| JP | 2006188338 | A | 7/2006 |

OTHER PUBLICATIONS

Abstract of JP 2002-300345 published Oct. 11, 2002.
Abstract of JP 2004-083210 published Mar. 18, 2004.
Abstract of JP 2005-324872 published Nov. 24, 2005.
Abstract of JP 2006-188338 published Jul. 20, 2006.

* cited by examiner

| FIG. 13A |
| --- |
| FIG. 13B |

SHEET CONVEYANCE DEVICE, AND IMAGE FORMING APPARATUS AND IMAGE READING UNIT INCLUDING SAME

CROSS-REFERENCE TO RELATED APPLICATIONS

This patent application is based on and claims priority pursuant to 35 U.S.C. §119 to Japanese Patent Application Nos. 2010-253051 filed on Nov. 11, 2010, and 2011-086986 filed on Apr. 11, 2011, in the Japanese Patent Office, the entire disclosure of each of which is hereby incorporated by reference herein.

FIELD OF THE INVENTION

The present invention generally relates to a sheet conveyance device, an image reading unit including same, and an image forming apparatus, such as a copier, a printer, a facsimile machine, or a multifunction machine including at least two of these functions, that includes a sheet conveyance device.

BACKGROUND OF THE INVENTION

Document reading devices typically include a document table on which multiple original documents can be stacked, an automatic document feeder (ADF) to transport the multiple original documents one by one from the document table to an image reading position, and an image reading unit to read image data of the original document. ADFs include a pickup roller that applies a transport force to the top sheet of a bundle of original documents stacked on the document table toward a separation unit. The separation unit includes, for example, a feed roller and a separator pressed against the feed roller, forming a nip (separation nip) therebetween. The separator separates the top sheet from the rest of original documents to feed each of the multiple original documents one by one to the image reading position.

In addition, for sequential sheet conveyance, ADFs include a trailing-edge detector disposed downstream from the separation nip in the direction in which the original document is transported (hereinafter "sheet conveyance direction"). The trailing-edge detector detects the trailing end of the original document that has passed through the separation nip (hereinafter "the preceding sheet"), which triggers feeding of a subsequent sheet from the multiple original document. The trailing-edge detector may be a reflection-type or transmission-type photosensor that directs light onto a surface of the original document to detect its presence, thereby determining whether the trailing end of the original document has passed by a predetermined detection position.

There is increasing demand for improving productivity in sequential sheet conveyance and streamlining the operation. Accordingly, various approaches are tried to reduce intervals between multiple original documents transported sequentially by ADFs.

For example, JP-2005-324872-A proposes increasing the velocity at which originals are transported (hereinafter "conveyance velocity of originals") through the separation nip from the conveyance velocity of original documents at the reading position in the above-described configuration, in which feeding of the subsequent sheet is triggered when the trailing end of the preceding sheet passes through a predetermined position downstream from the separation nip in the sheet conveyance direction. In this approach, while the preceding sheet is passing by the reading position, the subsequent sheet is transported through the separation nip at a velocity faster than the velocity at which the preceding sheet is transported by the reading position. Consequently, the interval between the sheets in sequential sheet conveyance can be reduced from when feeding of the subsequent sheet is started, thus enhancing productivity.

However, as the conveyance velocity at the reading position increases it becomes difficult to provide a significant difference between the velocity at which the separating unit transports original documents and the velocity at which the original document passed through the reading position for reducing intervals between sheets in sequential sheet conveyance. Therefore, it is preferred to reduce the interval between the preceding sheet and the subsequent sheet at the start of feeding the subsequent sheet. Although this objective may be attained by disposing the trailing-edge detector closer to the separation nip, it is possible that the leading end of the subsequent sheet transported together with the preceding sheet can project downward in the sheet conveyance direction beyond the separation nip, in which case the leading end of the subsequent sheet may face the trailing-edge detector and thus inhibit the trailing-edge detector from detecting the trailing end of the preceding sheet. Accordingly, it is difficult to dispose the trailing-edge detector sufficiently close to the separation unit to reduce intervals between sheets significantly.

BRIEF SUMMARY OF THE INVENTION

In view of the foregoing, in one embodiment of the present invention, a sheet conveyance device includes a loading section to accommodate multiple sheets stacked one on another, a first conveyance member disposed facing a top sheet of the multiple sheets set in the loading section, to apply a transport force to the top sheet of the multiple sheets, a separation section disposed downstream in a sheet conveyance direction from the first conveyance member to separate at a separation position one by one the multiple sheets transported by the first conveyance member, a first sheet length detector, a trailing-edge detector disposed downstream from the separation section in the sheet conveyance direction to detect a trailing edge of the sheet, a leading-edge detector to detect a leading edge of the sheet, and a controller to control sheet conveyance in accordance with detection of the first sheet length detector. The first sheet length detector detects whether a length of the sheet placed in the loading section is equal to or greater than a predetermined detection length (D1) in the sheet conveyance direction, and the predetermined detection length (D1) is slightly longer than a specific sheet size. The leading-edge detector is disposed downstream from the trailing-edge detector a distance smaller than the specific sheet size and downstream from the first conveyance member a distance longer than the specific sheet size in the sheet conveyance direction.

In a case in which the first sheet length detector detects that the length of the sheet placed in the loading section is equal to or greater than the predetermined detection length (D1) in the sheet conveyance direction, the controller starts feeding a subsequent sheet when the trailing-edge detector detects the trailing edge of a preceding sheet, in a case in which the first sheet length detector detects that the length of the sheet placed in the loading section is smaller than the predetermined detection length (D1) in the sheet conveyance direction, the controller starts feeding the subsequent sheet when either the leading-edge detector detects the leading edge of the preceding sheet or the trailing-edge detector detects the trailing edge of the preceding sheet.

In another embodiment, a sheet conveyance device includes a loading section to accommodate multiple sheets stacked one on another, a first conveyance member disposed facing a top sheet of the multiple sheets set in the loading section, to apply a transport force to the top sheet of the multiple sheets, a separation section disposed downstream in a sheet conveyance direction from the first conveyance member to separate at a separation position one by one the multiple sheets transported by the first conveyance member, a shifting unit to move the first conveyance member away from and toward the sheet set in the loading section, a first sheet length detector, a trailing-edge detector disposed downstream from the separation section in the sheet conveyance direction to detect a trailing edge of the sheet, a first leading-edge detector and a second leading-edge detector to detect a leading edge of the sheet disposed downstream from the trailing-edge detector in the sheet conveyance, and a controller to control sheet conveyance in accordance with detection by the first sheet length detector. The first sheet length detector detects whether the length of the sheet placed in the loading section is equal to or greater than a predetermined detection length (D1) in the sheet conveyance direction, and the predetermined detection length (D1) is slightly longer than a specific sheet size in the sheet conveyance direction. The first leading-edge detector is disposed downstream from the separation nip in the sheet conveyance direction a distance equal to a sum of the specific sheet size and a margin. The second leading-edge detector is disposed downstream from the first conveyance member in the sheet conveyance direction a distance equal to a sum of the specific sheet size and a margin.

In a case in which the first sheet length detector detects that the length of the sheet placed in the loading section is equal to or greater than the predetermined detection length (D1) in the sheet conveyance direction, the controller starts feeding a subsequent sheet when the trailing-edge detector detects the trailing edge of a preceding sheet. By contrast, in a case in which the first sheet length detector detects that the length of the sheet placed in the loading section is smaller than the predetermined detection length (D1) in the sheet conveyance direction, the controller starts the shifting unit to move the first conveyance member toward the sheet placed in the loading section when either the second leading-edge detector detects the leading edge of the preceding sheet or the trailing-edge detector detects the trailing edge of the preceding sheet. Additionally, when the second leading-edge detector detects the leading edge of the preceding sheet before the trailing-edge detector detects the trailing edge of the preceding sheet, the controller causes the first conveyance member to start feeding the subsequent sheet when the first conveyance member contacts the sheet placed in the loading section and the first leading-edge detector detects the leading edge of the sheet, or when the first conveyance member contacts the sheet placed in the loading section and the trailing-edge detector detects the trailing edge of the preceding sheet. By contrast, when the trailing-edge detector detects the trailing edge of the preceding sheet before the second leading-edge detector detects the leading edge of the preceding sheet, the controller causes the first conveyance member to start feeding the subsequent sheet when the first conveyance member contacts the sheet placed in the loading section.

Yet another embodiment provides an image reading device including a reading unit to read image data of an original document and the sheet conveyance device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
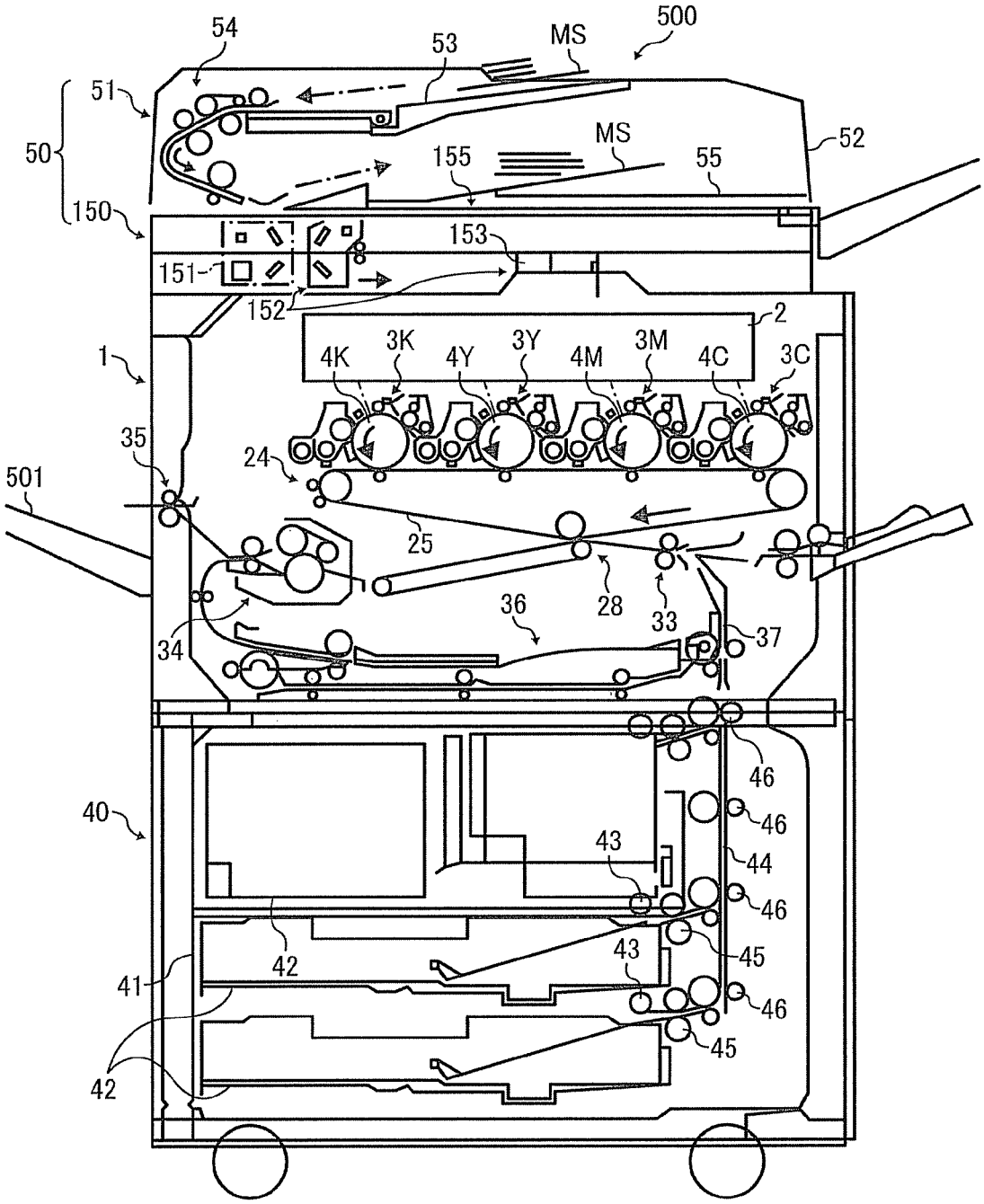
FIG. 1 is a schematic diagram illustrating a configuration of an image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an electrophotographic multicolor image forming apparatus according to an illustrative embodiment of the present invention is described.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary. Additionally, the term "substantially shorter" or "substantially smaller" relating to sheet length means that that length is shorter than the comparative length by an amount greater than fluctuations in detection, and the term "slightly shorter" or "slightly smaller" relating to sheet length means that that length is shorter than the comparative, length by an amount equal to fluctuations in detection.

FIG. 1 is a schematic diagram illustrating an image forming apparatus 500 that is a copier, for example. The image forming apparatus 500 includes an image forming unit 1, a sheet feeder 40, and an image reading unit 50. The image reading unit 50 includes a scanner 150 fixed on the image forming unit 1 and an automatic document feeder (ADF) 51 disposed above and supported by the scanner 150. The ADF 51 serves as a sheet conveyance device.

The sheet feeder 40 includes a paper bank 41 including two sheet cassettes 42, feed rollers 43, and separation rollers 45. The feed rollers 43 pick up transfer sheets (recording media) contained in the respective sheet cassettes 42 and send out the transfer sheet from the sheet cassettes 42. Then, the corresponding separation roller 45 separates the transfer sheet from the rest contained in the sheet cassette 42 and feeds it to a sheet feeding path 44. The sheet feeder 40 further includes multiple conveyance rollers 46 to transport the transfer sheet to a conveyance path 37 formed in the image forming unit 1. Thus, the transfer sheet contained in the sheet cassette 42 is transported to the conveyance path 3 in the image forming unit 1 (i.e., a main body).

Figure 6:
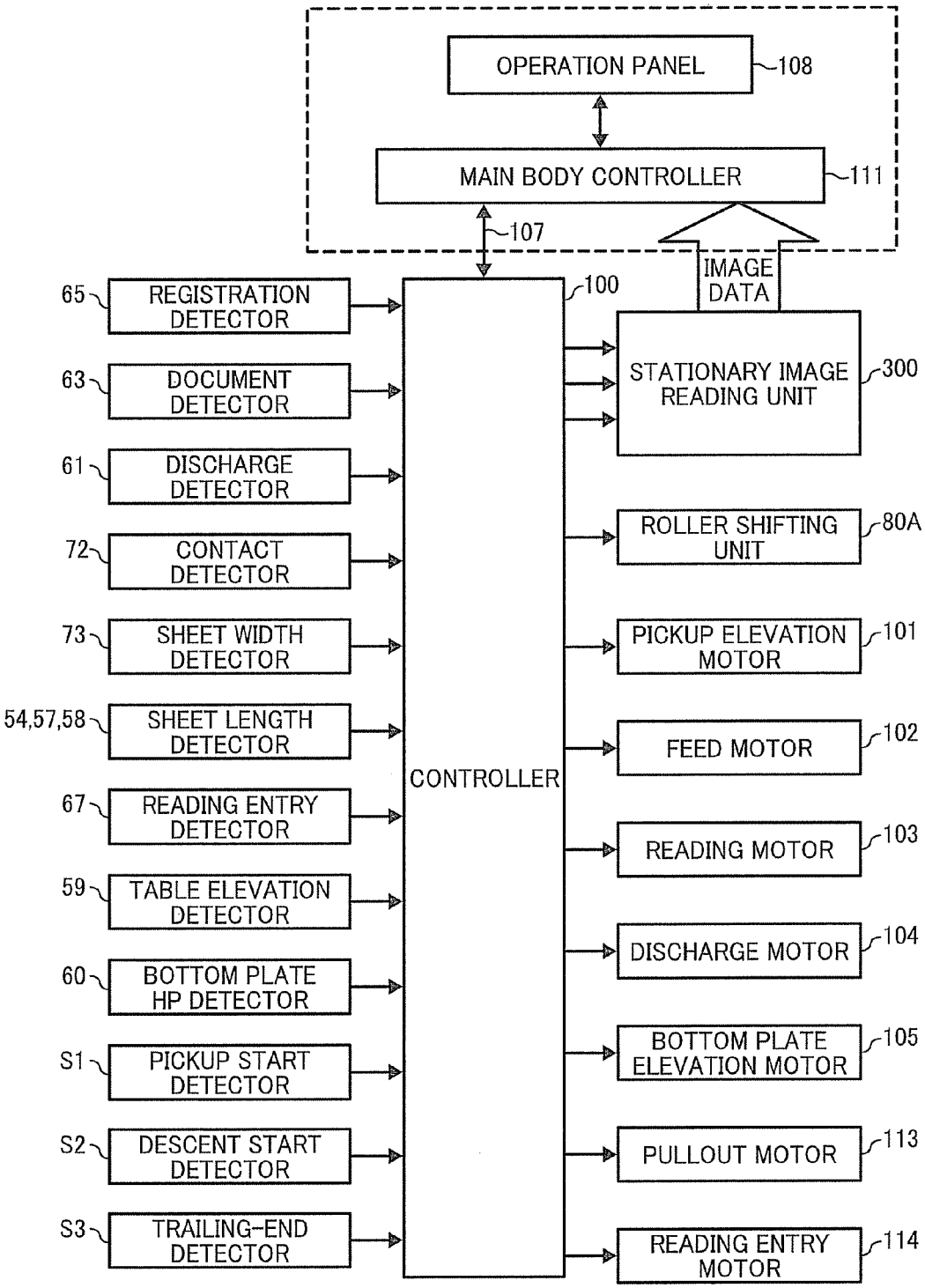
FIG. 6 is a block diagram illustrating a control block of the ADF.

The image forming unit 1 includes an optical writing device 2, four process units 3K, 3Y, 3M, and 3C for forming black (K), yellow (Y), magenta (M), and cyan (C) toner images, respectively, a transfer unit 24, a sheet conveyance unit 28, a pair of registration rollers 33, a fixing device 34, a switchback unit 36, and a controller 111 (also "main body controller 111") shown in FIG. 6 in addition to the conveyance path 37. The controller 111 drives a light source, such as a laser diode or light-emitting diode (LED), provided in the optical writing device 2 to direct laser beams (writing light) L to drum-shaped photoreceptors 4K, 4Y, 4M, and 4C. With the laser beams L, electrostatic latent images are formed on the respective photoreceptors 4K, 4Y, 4M, and 4C, which are developed into toner images in a development process.

Figure 2:
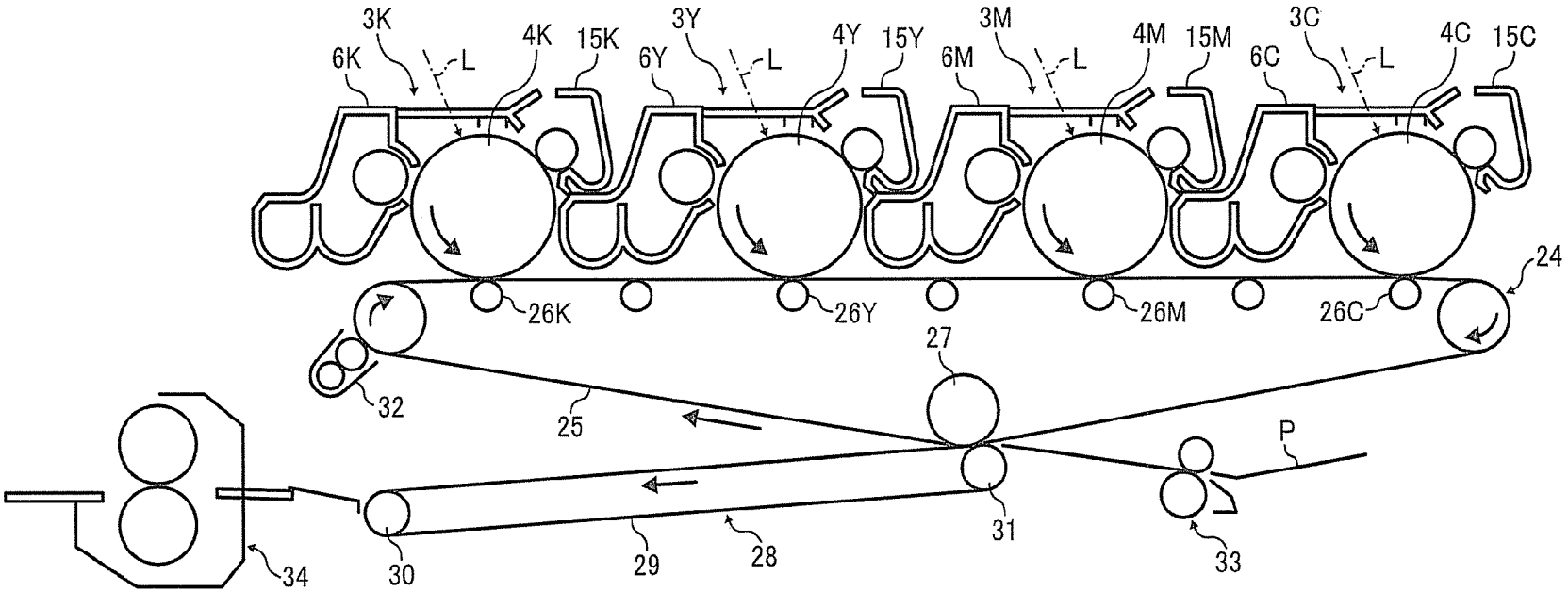
FIG. 2 is a schematic diagram illustrating an interior of an image forming unit in the image forming apparatus shown in FIG. 1.
Figure 3:
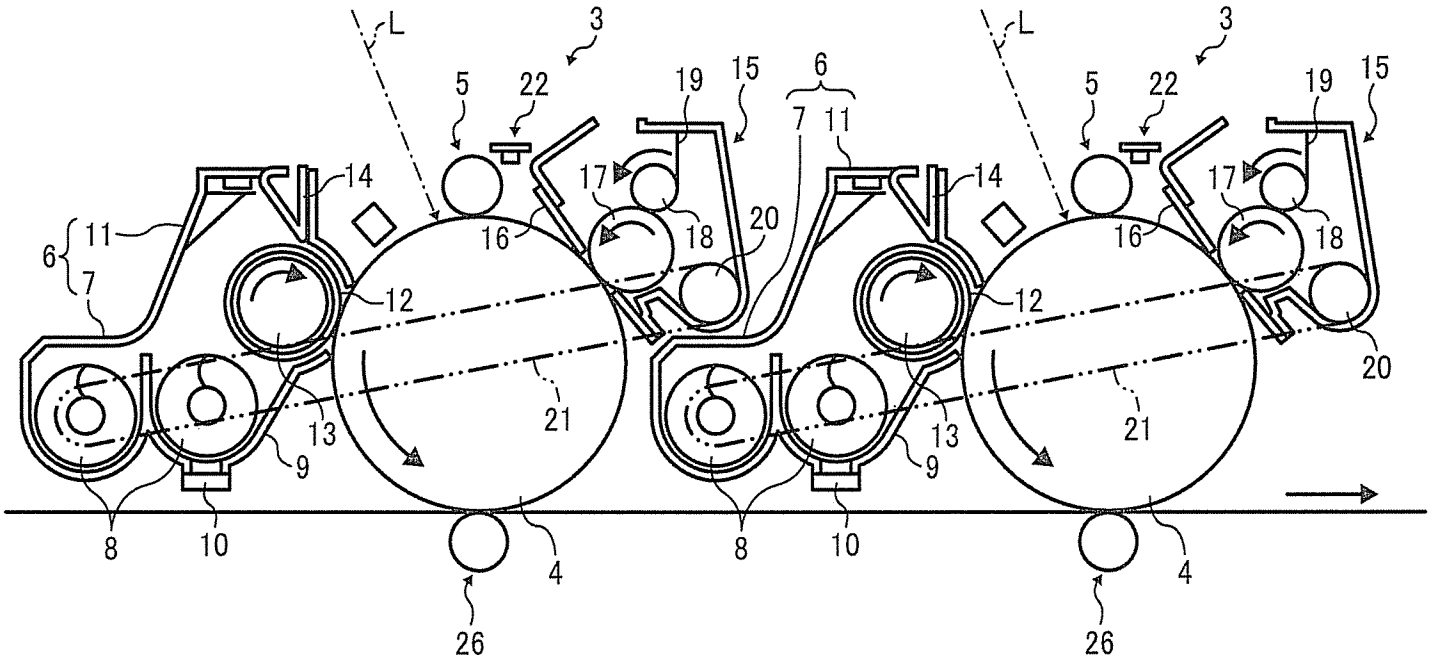
FIG. 3 is an enlarged view of a tandem unit including four process units in the image forming unit shown in FIG. 2.

FIG. 2 is a partial view that illustrates an interior of the image forming unit 1. FIG. 3 is an enlarged view of a tandem image forming unit including the four process units 3K, 3Y, 3M, and 3C. It is to be noted that the four process units 3K, 3Y, 3M, and 3C have a similar configuration except the color of toner used therein, and the subscripts K, K, M, and C attached to the end of reference numerals are omitted in FIG. 3.

In each process unit 3, the photoreceptor 4 and the components provided around the photoreceptor 4 are housed in a common casing, and each process unit 3 is removably installable in the image forming unit 1. The process unit 3 includes a charging member 5, a development device 6, a drum cleaning unit 15, and a discharge lamp 22, provided around the photoreceptor 4. The image forming apparatus 500 is tandem type and the four process units 3K, 3Y, 3M, and 3C are disposed facing an intermediate transfer belt 25 and arranged in parallel to each other in the direction in which the intermediate transfer belt 25 travels.

For example, the drum-shaped photoreceptor 4 includes an aluminum base pipe and an organic photosensitive layer overlying it. The photosensitive layer can be formed by application of an organic photosensitive material to the aluminum base pipe. The shape of the photoreceptor 4 is not limited thereto and may be shaped like an endless belt.

The development device 6 develops latent images formed on the photoreceptor 4 with two-component developer including magnetic carrier and nonmagnetic toner. The interior of the development device 6 is divided into an agitation compartment 7 for agitating the developer and a development compartment 11. The developer contained in the agitation compartment 7 is fed to a rotary development sleeve 12, from which the developer is transferred to the photoreceptor 4 in the development compartment 11.

The agitation compartment 7 is positioned lower than the development compartment 11 and includes two conveyance screws 8 arranged in parallel to each other, a partition disposed between them, and a toner concentration detector 10 provided on the bottom surface of a development casing 9.

The development compartment 11 includes the development sleeve 12 facing the photoreceptor 4 through an opening of the development casing 9, a stationary magnet roller 13 provided inside the development sleeve 12, and a doctor blade 14. An end of the doctor blade 14 is positioned adjacent to the development sleeve 12. The development sleeve 12 is a rotatable nonmagnetic cylindrical member. The magnet roller 13 includes multiple magnetic poles arranged in the direction of rotation of the development sleeve 12 from a position facing the doctor blade 14. These magnetic poles exert magnetic force on the two-component developer at predetermined positions in the direction of rotation of the development sleeve 12. With the magnetic force, the two-component developer transported from the agitation compartment 7 is attracted to the surface of the development sleeve 12, carried thereon, and is caused to form a magnetic brush on the development sleeve 12 along the magnetic force lines.

As the development sleeve 12 rotates, the magnetic brush passes through a position facing the doctor blade 14, where the amount of the magnetic bush is adjusted. Then, the magnetic brush is further transported to a development range facing the photoreceptor 4. The developer is transferred to the electrostatic latent image fowled on the photoreceptor 4 with the difference in electrical potential between a development bias applied to the development sleeve 12 and the electrostatic latent image. As the development sleeve 12 further rotates, the developer that has passed through the development range is returned to the development compartment 11, separated from the development sleeve 12 due to effects of a repulsive magnetic field generated between the magnetic poles of the magnet roller 13, and then is returned to the agitation compartment 7. Toner is supplied to the agitation compartment 7 as required based on detection results generated by the toner concentration detector 10. Alternatively, one-component development devices that use one-component developer that does not include magnetic carrier can be adopted.

Although the drum cleaning unit 15 includes an elastic cleaning blade 16 pressed against the photoreceptor 4 in the configuration shown in FIG. 3, different configurations may be used. To improve the cleaning performance, in the configuration shown in FIG. 3, an electroconductive fur brush 17 disposed rotatively in the direction indicated by arrow shown in FIG. 3 is used. An outer circumferential surface of the fur brush 17 contacts the photoreceptor 4. The fur brush 17 also serves as a lubricant applicator. The fur brush 17 scrapes off lubricant from a solid lubricant, making it into fine powder, and applies it to the surface of the photoreceptor 4. In addition, a metal electrical field roller 18 to apply a bias to the fur brush 17 is provided rotatively in the direction indicated by arrow shown in FIG. 3, and an end of a scraper 19 is pressed against the electrical field roller 18. The bias is applied to the electrical field roller 18 while the electrical field roller 18 rotates in the direction counter to the direction of rotation of the fur brush 17 and contacts the fur brush 17. Thus, the toner adhering to the fur brush 17 is transferred to the electrical field roller 18. The toner is removed from the electrical field roller 18 by the scraper 19 and drops to a collecting screw 20. The collecting screw 20 transports the toner removed from the electrical field roller 18 to an end in the direction perpendicular to the surface of the paper on which FIG. 3 is drawn and send it to a recycle toner conveyance unit 21 provided outside the drum cleaning unit 15. The recycle toner conveyance unit 21 transports the toner to the development device 6 for reuse.

The discharge lamp 22 discharges the surface of the photoreceptor 4 with irradiation of light. Then, the surface of the photoreceptor 4 is charged uniformly by the charging member 5, after which the optical writing device 2 performs optical writing. It is to be noted that, although the roller-shaped charging member 5 disposed in contact with the photoreceptor 4, to which a charge bias is applied, is used in the present embodiment, contactless scorotron chargers or the like may be used.

Through the process described above, black, yellow, magenta, and cyan toner images are formed on the photoreceptors 4K, 4Y, 4M, and 4C in the respective process units 3K, 3Y, 3M, and 3C.

The transfer unit 24 is provided beneath the four process units 3K, 3Y, 3M, and 3C. In the transfer unit 24, the intermediate transfer belt 25 is stretched around multiple rollers. The intermediate transfer belt 25 moves clockwise in the drawing and slidingly contacts the photoreceptors 4K, 4Y, 4M, and 4C. Where the photoreceptors 4K, 4Y, 4M, and 4C are in contact with the intermediate transfer belt 25 are called primary-transfer nips. Primary-transfer rollers 26K, 26Y, 26M, and 26C are provided inside the loop of the intermediate transfer belt 25 and adjacent to the respective primary-transfer nips. The primary-transfer rollers 26K, 26Y, 26M, and 26C press the intermediate transfer belt 25 against the photoreceptors 4K, 4Y, 4M, and 4C, respectively. A primary-transfer bias is applied to each primary-transfer roller 26. Thus, primary-transfer electrical fields are formed in the primary-transfer nips to transfer the toner images formed on the respective photoreceptors 4K, 4Y, 4M, and 4C electrostatically onto the intermediate transfer belt 25. As the intermediate transfer belt 25 rotates clockwise in FIG. 2 and passes through the four primary-transfer nips sequentially, the toner images are superimposed one on another on a front surface of the intermediate transfer belt 25 in the primary-transfer process. Thus, a superimposed four-color toner image is formed on the intermediate transfer belt 25.

The sheet conveyance unit 28 is positioned beneath the transfer unit 24 in FIG. 1 and includes an endless conveyance belt 29 that rotates endlessly, stretched between a driving roller 30 and a secondary-transfer roller 31. The intermediate transfer belt 25 and the conveyance belt 29 are nipped between the secondary-transfer roller 31 and a tension roller 27. Thus, the front surface of the intermediate transfer belt 25 is in contact with a front surface of the conveyance belt 29, forming a secondary-transfer nip. A secondary-transfer bias is applied to the secondary-transfer roller 31 from a power source. By contrast, the tension roller 27 of the transfer unit 24 is grounded. Thus, a secondary-transfer electrical field is generated in the secondary-transfer nip.

The registration rollers 33 are positioned on the right of the secondary-transfer nip in FIG. 2. Additionally, a registration roller detector is provided adjacent to an entrance of the nip between the registration rollers 33 (registration nip). After a predetermined time has elapsed from when the registration roller detector detects the leading edge of the transfer sheet P transported from the sheet feeder 40 to the registration rollers 33, conveyance of the transfer sheet P is suspended, and the leading edge of the transfer sheet P is caught in the nip between the registration rollers 33. Thus, the position of the transfer sheet P is adjusted, and the transfer sheet P is prepared for synchronization with image formation.

When the leading-edge portion of the transfer sheet P is caught in the registration nip, the registration rollers 33 resumes rotation to forward the transfer sheet P to the secondary-transfer nip, timed to coincide with the four-color toner image formed on the intermediate transfer belt 22. In the secondary-transfer nip, the four-color toner image is transferred secondarily from the intermediate transfer belt 25 onto the transfer sheet P at a time and becomes a full-color toner image (hereinafter "multicolor toner image") on the while transfer sheet P. After passing through the secondary-transfer nip, the transfer sheet P is separated from the intermediate transfer belt 25 and is carried on the front side of the conveyance belt 29. As the conveyance belt 29 rotates, the transfer sheet P is transported to the fixing device 34.

Herein, some toner tends to remain on the front surface of the intermediate transfer belt 25 that has passed through the secondary-transfer nip. The toner remaining on the intermediate transfer belt 25 is removed by a belt cleaning unit 32 disposed in contact with the intermediate transfer belt 25.

In the fixing device 34, the full-color toner image is fixed on the transfer sheet P with heat and pressure, after which the transfer sheet P is discharged by a pair of discharge rollers 35 outside the apparatus onto a discharge tray 501.

The switchback unit 36, positioned beneath the sheet conveyance unit 28 and the fixing device 34 in FIG. 1, is a mechanism for reversing transfer sheets. In duplex printing, after an image is fanned on one side of the transfer sheet P, the conveyance route of the transfer sheet P is switched with a switching pawl toward the switchback unit 36. Then, the transfer sheet P is reversed and transported again to the secondary-transfer nip. After an image is formed on the other side of the transfer sheet P, the transfer sheet P is discharged to the discharge tray 501.

The image reading unit 50 further includes a first stationary reading unit 151 provided in the scanner 150, a second stationary reading unit 95 (shown in FIG. 5) provided in the ADF 51, a movable reading unit 152, and a second exposure glass 155 fixed to an upper wall of the casing of the scanner 150 to contact the original document MS. The movable reading unit 152 is positioned immediately below the second exposure glass 155 and can move an optical system including a light source and multiple reflecting mirrors laterally in FIG. 1. While moving the optical system from the left to the right in FIG. 1, the light emitted from the light source is reflected on the lower side of the original document MS placed on the second exposure glass 155 and directed via the multiple reflecting mirrors to an image reading sensor 153 fixed to the scanner 150.

Figure 7:
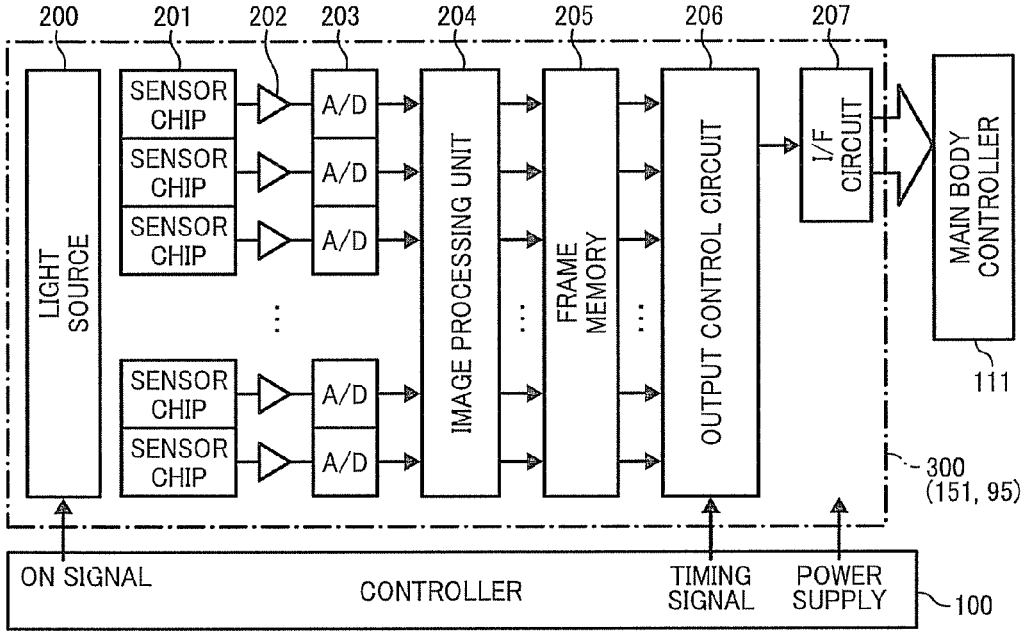
FIG. 7 is a block diagram of a control block of a stationary image reading unit.

The first stationary reading unit 151 and the second stationary reading unit 95 together form a stationary reading unit 300 (shown in FIG. 7). The first stationary reading unit 151 includes a light source, reflecting mirrors, and a charge-coupled device (CCD) and is positioned immediately below a first exposure glass 154 fixed to the upper wall of the casing of the scanner 150. When the original document MS transported by the ADF 51 passes above the first exposure glass 154, the light emitted from the light source is reflected on a first side of the original document MS and directed via the multiple reflecting mirrors to the image reading sensor 153. Thus, without moving the optical system including the light source and the reflecting mirrors, the first side of the original document MS can be scanned. The second stationary reading unit 95 scans a second side of the original document MS that has passed through the first stationary reading unit 151.

Figure 4:
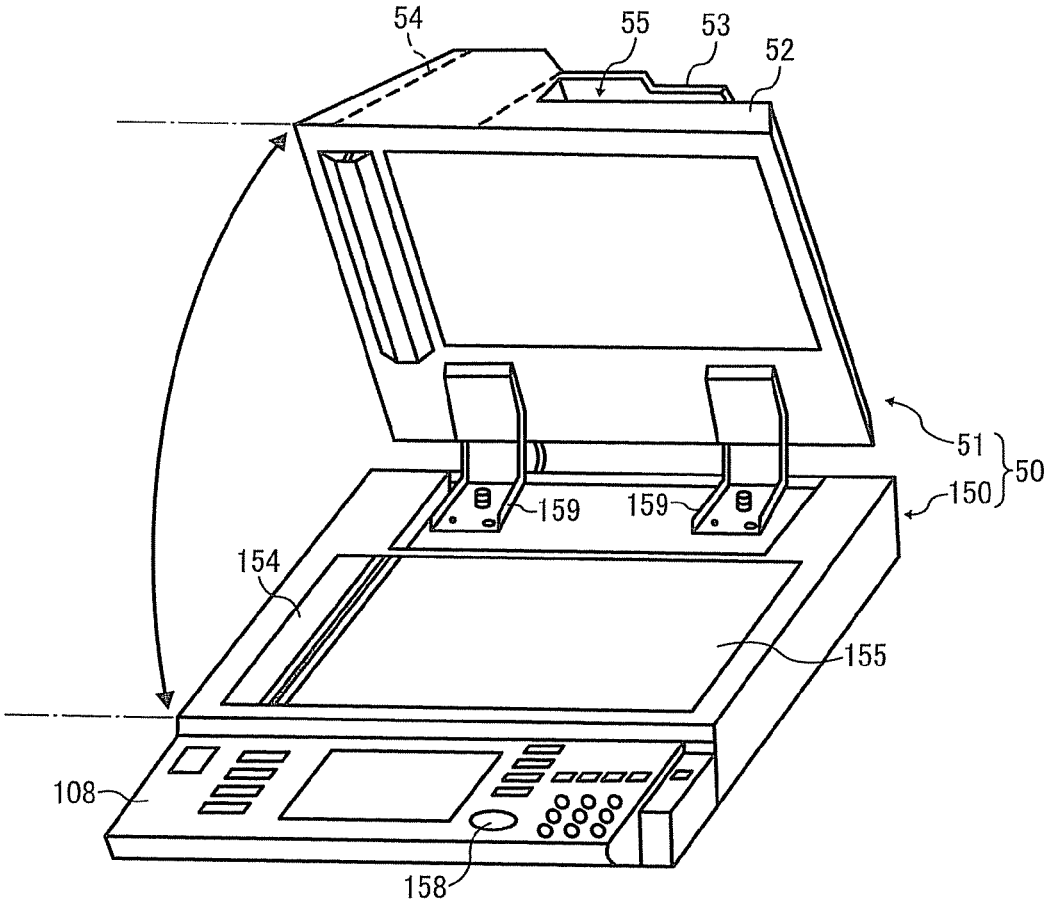
FIG. 4 is a perspective view illustrating a scanner and an automatic document feeder (ADF) included in the image forming apparatus.

An ADF cover 52 of the ADF 51 provided above the scanner 150 holds a document table 53 on which original documents MS to be scanned are set, a document conveyance unit 54, and a document stack table 55 on which the original documents MS are stacked after image scanning. As shown in FIG. 4, the ADF 51 is hinged by hinges 159 fixed to the scanner 150 and is pivotable vertically. Thus, the ADF 51 can be lifted to open relative to the scanner 150. When the ADF 51 is lifted, the first exposure glass 154 and the second exposure glass 155 on the upper side of the scanner 150 are exposed. When original documents are bound together, in particular, stitched or stapled on one side (hereinafter "side-stitched documents") like books, the originals cannot be separated one by one and cannot be transported by the ADF 51. Therefore, in the case of a bundle of side-stitched documents, the automatic document feeder 51 is lifted as shown in FIG. 4, and the bundle of side-stitched documents is opened to the page to be scanned and placed on the second exposure glass 155 with the page faced down, after which the ADF 51 is moved down to close. Then, the movable reading unit 152 shown in FIG. 1 of the scanner 150 reads image data of that page.

By contrast, when not bound together, a bundle of original documents MS can be transported by the ADF 51 one by one and then sequentially read by the first stationary reading unit 151 in the scanner 150 and the second stationary reading unit 95 in the ADF 51. In this case, users place the bundle on the document table 53 and push a start button 158 in an operation panel 108 (shown in FIG. 4). Then, the ADF 51 forwards the bundle of original documents MS set on the document table 53 sequentially from the top to the document conveyance unit 54 and reverses the original documents MS to the document stack table 55. In this process, the original document MS passes above the first stationary reading unit 151 of the scanner 150 immediately after being reversed. At that time, the first stationary reading unit 151 reads image data of the first side of the original document MS.

Next, the ADF 51 is described in further detail below.

Figure 5:
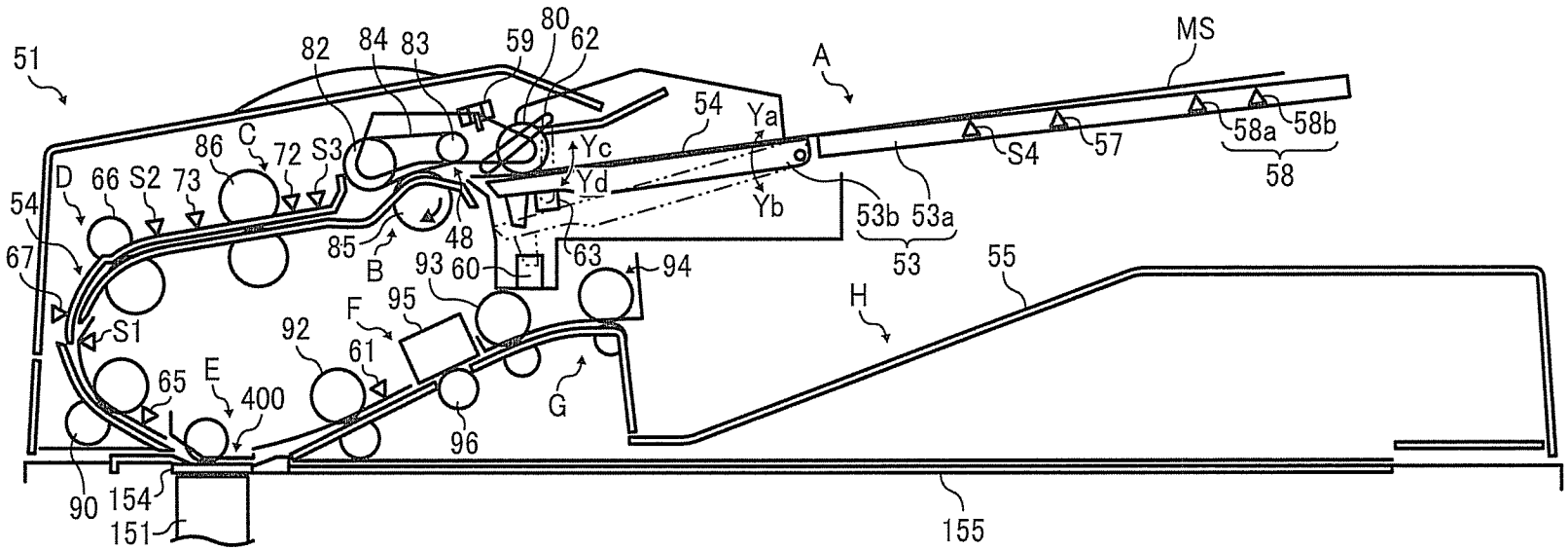
FIG. 5 is a schematic view of the ADF and an upper portion of the scanner.

FIG. 5 is an enlarged view that illustrates a main part of the ADF 51 and the upper portion of the scanner 150.

The ADF 51 includes a document loading section A, a separation section B, a registration section C, a turning section D, a first reading section E, a second reading section F, a discharge section G, and a stack section H, arranged in that order in the sheet conveyance direction in the ADF 51. The ADF 51 according to the present embodiment further includes a trailing-edge detector S3 provided downstream from the separation section B and a pair of reading entrance rollers 90. The document conveyance unit 54 constitutes a conveyance path of the original document MS extending from a detection position by the trailing-edge detector S3 to the pair of reading entrance rollers 90.

The document loading section A includes the document table 53 on which the bundle of original documents MS is placed with the first side faced up. The separation section B separates and transports the bundle of original documents MS one by one. The registration section C stops the original document MS temporarily for alignment and forwards the original document MS downstream in the sheet conveyance direction. The turning section D includes a C-shaped curved portion in which the original document MS is folded back to be reversed upside down so that the first side of the original document MS is faced down. In the first reading section E, the first stationary reading unit 151 provided in the scanner 150 reads from below the first side of the original document MS while the original document MS is transported above the first exposure glass 154. In the second reading section F, while a support roller 96 provided beneath the second stationary reading unit 95 transports the original document MS, the second stationary reading unit 95 reads the second side of the original document MS. The discharge section G discharges the original document MS to the stack section H after image scanning. The stack section H is for stacking the original documents MS on the document stack table 55.

FIG. 6 is a block diagram illustrating a control block of the ADF 51.

The control block of the ADF 51 includes a driving unit for document feeding, various detectors or sensors, a stationary image reading unit 300 (the first stationary reading unit 151 or the second stationary reading unit 95), and the controller 100 that controls a sequence of operations of the ADF 51. The driving unit for document feeding includes a pickup elevation motor 101, a feed motor 102, a reading motor 103, a discharge motor 104, a bottom plate elevation motor 105, a pullout motor 113, and a reading entry motor 114. The detectors include the registration detector 65, a document detector 63, a discharge detector 61, a contact detector 72, a sheet width detector 73, sheet length detectors S4, 54, 57, and 58, a reading entry detector 67, a table elevation detector 59, a bottom plate home position (HP) detector 60, a pickup start detector S1 to detect the conveyance start of a pickup roller 80 (first conveyance member), a descent start detector S2 to detect when the pickup roller 80 starts descending, and the trailing-edge detector S3.

FIG. 7 is a block diagram of a control block of the stationary image reading unit 300. As shown in FIG. 7, the stationary image reading unit 300 includes a light source 200 that can be a light-emitting diode (LED), a fluorescent, or a cold cathode tube, for example. The stationary image reading unit 300 further includes multiple sensor chips 201 arranged in a main scanning direction (width direction of original documents), multiple individual OP amplifier circuits 202 connect to the respective sensor chips 201, and multiple A/D converters 203 connect to the respective OP amplifier circuits 202. The stationary image reading unit 300 further includes an image processing unit 204, a frame memory 205, an output control circuit 206, and an interface (I/F) circuit 207.

The sensor chips 201 each include a condenser lens and a photoelectric conversion element called a contact-type same size image sensor. Before the original document MS reaches the reading position by the stationary image reading unit 300, the controller 100 transmits a light ON signal to the light source 200. Then, the light source 200 directs light to the second side of the original document MS. The light reflected on the second side of the original document MS is then focused by the condenser lens of the sensor chips 201 on the photoelectric conversion element, and the light is read as image data. The image data read by the respective sensor chips 201 is amplified by the OP amplifier circuits 202 and converted by the A/D converters 203 into digital image data. The digital image data is input to the image processing unit 204, and shading and the like are corrected, after which the digital image data is temporary stored in the frame memory 205. Subsequently, the digital image data is converted by the output control circuit 206 into data acceptable to the main body controller 111 and output via the I/F circuit 107 to the controller 111.

It is to be noted that the controller 100 outputs a timing signal that indicates the timing at which the leading-edge portion of the original document MS reaches the reading position by the stationary image reading unit 300 (image data read after that timing is deemed effective) and ON signals to turn the light sources and power sources.

The document table 53, on which the original documents MS to be scanned are placed with the first side faced up, includes a movable document table 53*b* that supports the leading-edge portion of the original document MS and a stationary document table 53*a* that supports the trailing end portion of the original document MS. The movable document table 53*b* is movable in the directions indicated by arrows Ya and Yb shown in FIG. 5. On the document table 53, side guides are brought into contact with both sides of the original document MS in the width direction of the original document MS, perpendicular to the sheet conveyance direction. Thus, the position of the original document MS in the width direction is determined.

A set filler 62 serving as a lever is provided pivotably above the movable document table 53*b*, and the original document MS set on the document table 53 pushes up the set filler 62. Accordingly, the document detector 63 detects presence of original document MS set on the document table 53 and transmits a detection signal to the controller 100. Further, the controller 100 transmits the detection signal to the main body controller 111 via the I/F circuit 107 (hereinafter simply "I/F 107").

The stationary document table 53*a* is provided with the sheet length detectors S4, 57, 58*a*, and 58*b* to detect the length of the original document MS in the sheet conveyance direction. Each of them can be a reflective photosensor or an actuator-type sensor capable of detecting the length of the original even when only a single sheet is set on the document table 53. With these detectors, the length of the original document MS in the sheet conveyance direction is roughly determined. It is to be noted that detectors capable of determining at least whether a given sheet size is placed lengthwise or sideway are necessary.

The pickup roller 80 is provided above the movable document table 53*b*. The bottom plate elevation motor 105 causes the movable document table 53*b* to pivot in the direction indicated by arrows Ya and Yb shown in FIG. 5 via a table shifting unit such as a cam mechanism. When it is detected that a bundle of original documents MS is set on the document table 53 using the set filler 62 and the document detector 63, the controller 100 rotates the bottom plate elevation motor 105 in a forward direction to lift the document table 53 so that the top side of the bundle contacts the pickup roller 80.

The pickup roller 80 is movable in the direction indicated by arrows Yc and Yd in FIG. 5 with a roller shifting unit 80A, such as a cam mechanism, driven by a pickup elevation motor 101. Additionally, as the movable document table 53*b* ascends, the pickup roller 80 ascends in the direction indicated by arrow Yc in FIG. 5, pressed by the upper side of the original documents MS set on the movable document table 53*b*. The table elevation detector 59 detects elevation of the pickup roller 80, and thus it is detected that the movable document table 53*b* has ascended to an upper limit. Then, the pickup elevation motor 101 as well as the bottom plate elevation motor 105 stops. When document feeding is repeated, and accordingly the upper side of the bundle of original documents MS descends, the table elevation detector 59 stops detecting elevation of the movable document table 53*b*. Then, the movable document table 53*b* is elevated until the table elevation detector 59 detects elevation thereof again. This operation is repeated to keep the upper side of the bundle of original documents MS at a height suitable for document feeding.

When the user presses the start button 158 provided on the operation panel 108, a document feeding signal is transmitted from the controller 111 in the main body via the I/F 107 to the controller 100 of the ADF 51. Then, the feed motor 102 is driven to rotate the pickup roller 80, and the pickup roller 80 picks up one or several sheets (preferably, a single sheet) from the bundle of original documents MS set on the document table 53. The pickup roller 80 rotates in the direction to transport the top sheet of the bundle of original documents MS to a feeding opening 48.

The original document MS sent out by the pickup roller 80 enters the separation section B and is transported to a position to contact a conveyance belt 84 (second conveyance member). The conveyance belt 84 is stretched around a driving roller 82 and a driven roller 83 and endlessly rotates clockwise in FIG. 5 as the driving roller 82 rotates, driven by rotation of the feed motor 102 in a forward direction (forward rotation).

Figure 8:
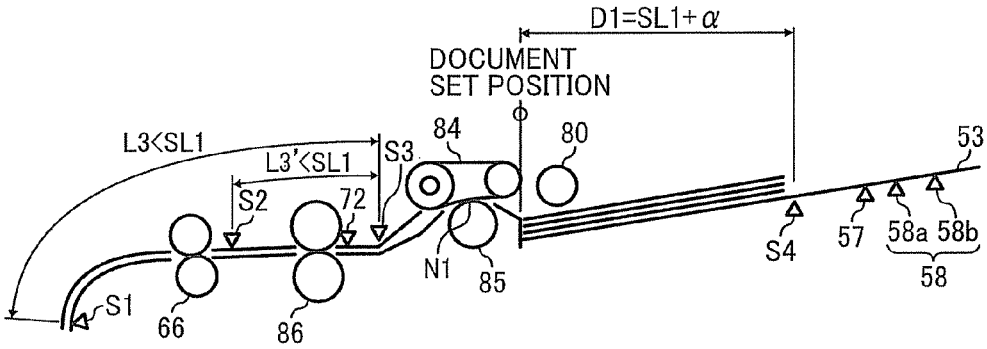
FIG. 8 is a schematic view of a document set section, a separation section, a registration section, and a part of a turning section of the ADF.

A reverse roller 85 serving as a separator is provided in contact with a lower portion of the conveyance belt 84 stretched laterally in FIG. 5, thus forming a separation nip N1 (i.e., a separation portion) shown in FIG. 8. The reverse roller 85 rotates clockwise in FIG. 5, driven by the forward rotation of the feed motor 102. In the separation nip, the conveyance belt 84 moves in the sheet conveyance direction. Although the reverse roller 85 tries to rotate in the direction opposite the sheet conveyance direction, a drive transmission unit for the reverse roller 85 includes a torque limiter, and the reverse roller 85 rotates in the sheet conveyance direction when the force in the sheet conveyance direction is greater than the torque of the torque limiter. The reverse roller 85 is pressed against the conveyance belt 84 at a predetermined pressure. When the reverse roller 85 is in direct contact with the conveyance belt 84, or only a single original document MS is present in the separation nip N1, the reverse roller 85 rotates in the direction in which the conveyance belt 84 or the original document MS moves. However, when multiple original documents MS are present in the separation nip N1, the reverse roller 85 rotates clockwise in FIG. 5, opposite the direction in which the conveyance belt 84 moves, because the force to follow rotation of the conveyance belt 84 is lower than the torque of the torque limiter. With this configuration, the reverse roller 85 applies a force in the direction opposite the sheet conveyance direction to the sheets lower than the top sheet, thus separating the top sheet from the rest when multiple sheets are sent to the separation nip N1 at a time. Thus, multifeed, which is a feeding error in which multiple sheets are fed at a time, can be prevented.

The original document MS separated from the rest by the conveyance belt 84 and the reverse roller 85 then enters the registration section C. The original document MS is further transported by the conveyance belt 84, and the contact detector 72 detects a leading edge of the original document MS. The original document MS is further transported to contact a pair of pullout rollers 86 that stays motionless. Subsequently, the feed motor 102 is driven for a predetermined period from when the contact detector 72 detects the leading edge of the original document MS and stops. With this operation, the original document MS is transported a predetermined amount from the position where the original document MS is detected by the contact detector 72. Consequently, conveyance of the original document MS by the conveyance belt 84 is stopped with the original document MS pressed against the pair of pullout rollers 86 and deformed a predetermined amount.

When the contact detector 72 detects the leading edge of the original document MS, the pickup elevation motor 101 is rotated, thus moving away the pickup roller 80 from the upper side of the original document MS. Then, the original document MS is transported with only the conveyance force exerted by the conveyance belt 84. Thus, the leading edge of the original document MS enters a nip formed between the pullout rollers 86, and alignment of the leading edge (skew correction) is performed.

The pair of pullout rollers 86 has a capability of skew correction as described above and further serves as conveyance rollers to transport the aligned original document MS to a pair of intermediate rollers 66 after the original document MS is separated from the rest and aligned. The pullout motor 113 drives one of the pullout rollers 86. Alternatively, one of the pullout rollers 86 may be driven by reverse rotation of the feed motor 102, thus obviating the need of the pullout motor 113. When the feed motor 102 is rotated in reverse, the pickup roller 80 as well as the driving roller 82 is configured not to be driven.

The original document MS forwarded by the pair of pullout rollers 86 then passes immediately below the sheet width detector 73. The sheet width detector 73 includes multiple sheet detectors, such as reflective photosensors or the like, arranged in the width direction of the original document MS, perpendicular to the surface of the paper on which FIG. 5 is drawn. The size of the original document MS in the width direction can be recognized based on which of the multiple sheet detectors detects the original document MS. The length of the original document MS in the sheet conveyance direction is recognized based on the motor pulses during the period from when the contact detector 72 detects the leading edge of the original document MS to when the contact detector 72 stops detecting the original document MS, that is, the contact detector 72 detects passage of the trailing end of the original document MS.

The original document MS is transported by the pair of pullout rollers 86 and the pair of intermediate rollers 66 to the turning section D, in which the pair of intermediate rollers 66 and the pair of reading entrance rollers 90 transport the original document MS.

The pair of intermediate rollers 66 receives driving force from the pullout motor 113 to drive the pair of pullout rollers 86 as well as the reading entry motor 114 to drive the pair of reading entrance rollers 90. The intermediate rollers 66 are provided with a mechanism to set the rotational velocity in accordance with driving of one of the two motors that rotates faster.

In the image reading unit 50, when the original document MS is transported from the registration section C to the turning section D by the pair of pullout rollers 86 and the pair of intermediate rollers 66, the conveyance velocity in the registration section C is faster than the conveyance velocity in the first reading section E to reduce the time required to forward the original document MS to the first reading section E. At that time, the pair of intermediate rollers 66 is driven by the pullout motor 113.

When the reading entry detector 67 detects the leading edge of the original document MS, deceleration of the pullout motor 113 is started to reduce the conveyance velocity to the conveyance velocity in the first reading section E before the leading edge of the original document MS enters the nip formed between the reading entrance rollers 90. Simultaneously, the reading entry motor 114 as well as the reading motor 103 starts forward rotation. The forward rotation of the reading entry motor 114 causes the pair of reading entrance rollers 90 to rotate in the sheet conveyance direction. Additionally, the forward rotation of the reading motor 103 causes a pair of first reading exit rollers 92 as well as a pair of second reading exit rollers 93 to rotate in the sheet conveyance direction.

When the registration detector 65 detects the leading edge of the original document MS moving from the turning section D to the first reading section E, the controller 100 takes a predetermined or given time period to decelerate the respective motors so that the conveyance velocity of the original document MS can be decelerated while the original document MS travels a predetermined or given distance. Then, the controller 100 stops the original document MS upstream from a first reading position 400 at which the first stationary reading unit 151 scans the original document MS and transmits a registration stop signal to the main body controller 111 via the I/F 107.

Subsequently, receiving a reading start signal from the main body controller 111, the controller 100 controls driving of the reading entry motor 114 as well as the reading motor 103 to raise the conveyance velocity of the original document MS to a predetermined velocity before the leading edge of the originals MS, which is stopped for registration at that time, arrives at the first reading position 400. With this operation, the original document MS is transported to the first reading position 400 while the conveyance velocity thereof is increased. The controller 100 of the ADF 50 transmits to the controller 111 a gate signal indicating an effective image area of the original document MS in a sub-scanning direction at a timing at which the leading edge of the original document MS is expected to arrive at the first reading position 400, calculated based on the pulse count of the reading entry motor 114. The transmission of the gate signal is continued until the trailing end of the original document MS exits from the first reading position 400, and the first stationary reading unit 151 reads image data on the first side of the original document MS.

After passing through the first reading section E, the original document MS passes through the nip between the first reading exit rollers 92, after which the discharge detector 61 detects the leading edge of the original document MS. The original document MS is further transported through the second reading section F to the discharge section G.

In single-side scanning to read image data of only one side (first side) of the original document MS, image reading by the second stationary reading unit 95 is not necessary. Therefore, when the discharge detector 61 detects the leading edge of the original document MS, the discharge motor 104 starts forward rotation, thereby rotating the upper discharge roller 94 counterclockwise in FIG. 5. In addition, the timing at which the trailing end of the originals MS exits from the nip between the discharge rollers 94 is estimated based on the pulse count of the discharge motor 104 counted after the discharge detector 61 detects the leading edge of the original document MS. Then, based on the estimated timing, the discharge motor 104 is decelerated immediately before the trailing end of the originals MS exits from the nip between the discharge rollers 94 to transport the original document MS to the document stack table 55 at such a velocity that the original document MS does not fall from the document stack table 55.

By contrast, in double-side scanning to read image data of both sides (first and second sides) of the original document MS, after the discharge detector 61 detects the leading edge of the original document MS, the timing at which the original document MS arrives at the second stationary reading unit 95 is estimated based on the pulse count of the reading motor 103. Then, at the estimated timing, the controller 100 transmits, to the main body controller 111, a gate signal indicating an effective image area of the second side of the original document MS in the sub-scanning direction. The transmission of the gate signal is continued until the trailing end of the original document MS exits from the second reading position by the second stationary reading unit 95, and the second stationary reading unit 95 reads image data on the second side of the original document MS.

It is to be noted that the scanning mode, single-side scanning or double-side scanning, may be set for each bundle of original documents stacked on the document table 53 or individually for each sheet in the bundle. More specifically, a single bundle of original documents stacked on the document table 53 may be scanned in the same mode. Alternatively, for example, the first and tenth sheets in a single bundle of original documents may be subjected to double-side scanning and the rest in the identical bundle subjected to single-side scanning.

The second stationary reading unit 95 includes a contact-type image sensor (CIS), and its reading surface is coated to prevent pasty substances adhering to the original document MS; if any, from being transferred to the reading surface of the CIS, thus preventing detective reading resulting in vertical lines. In addition, the support roller 96 is provided at a position facing the second stationary reading unit 95 via the conveyance route through which the original document MS travels to support the original document MS from the side (first side) that is not read by the second stationary reading unit 95. The support roller 96 prevents floating of the original document MS at a position where the second stationary reading unit 95 reads the image data thereof and serves as a white base for acquiring shading data in the second stationary reading unit 95.

Next, control of sequential document feeding is described below.

To improve the productivity and to simplify adjustment of intervals between sheets, it is ideal to start feeding the subsequent sheet immediately after the preceding sheet exits from the separation nip N1 (separation position). In this way, the period during which the sheet is kept at the pair of pullout rollers 86 can be relatively long, and intervals between sheets can be adjusted by changing the period during which the pair of pullout rollers 86 is kept motionless. Thus, it is easy to improve the productivity and control intervals between sheets.

Typically, feeding of the subsequent sheet is started after the trailing-edge detector S3 detects the trailing end of the preceding sheet. To start feeding the subsequent sheet immediately after the preceding sheet exits from the separation nip N1 (separation position), although it is preferable that the trailing-edge detector S3 be positioned close to the separation nip N1, it is difficult due to the following reasons. In the configuration in which the trailing-edge detector S3 is positioned close to the separation nip N1, if the leading edge of the subsequent sheet projects beyond the separation nip N1 and faces the trailing-edge detector S3 before the trailing end of the preceding sheet exits from the separation nip N1, it is possible that the trailing-edge detector S3 fails to detect the trailing end of the preceding sheet. Further, in the present embodiment, to correct skew, the feed motor 102 is driven for the predetermined time after the leading edge of the original document MS contacts the pullout rollers 86, thereby pressing the original document MS against the pair of pullout rollers 86 with the original document MS deforming by the determined amount. Accordingly, as shown in FIG. 5, space sufficient for the original document MS to deform is provided adjacent to the separation nip N1. In this configuration, the conveyance route of the original document MS is not stable around the separation nip N1. Therefore, when the trailing-edge detector S3 is positioned close to the separation nip N1, it is possible that the accuracy in detection of the trailing end of the original document MS by the trailing-edge detector S3 is not high.

In view of the foregoing, it is typically preferred that the trailing-edge detector S3 be disposed at a given distance from the separation nip N1 to detect the trailing end of the original document MS with a high degree of accuracy.

Additionally, in conveyance of originals with holes, such as punched sheets, that are not detected temporarily, it is necessary to prevent erroneous detection by the trailing-edge detector S3. More specifically, when the trailing-edge detector S3 stops detecting the original document MS, the controller 100 determines that the trailing-edge detector S3 has detected the trailing end of the original document MS not immediately but after confirming that the trailing-edge detector S3 does not resume detecting the original document MS after a predetermined time. Thus, improvement of the productivity is limited in configurations in which feeding of the subsequent sheet is triggered by detection by the trailing-edge detector S3.

In view of the foregoing, a comparative image reading unit, described below, is suggested.

The comparative image reading unit includes a leading-edge detector to detect the leading edge of original documents at a position downstream from the separation nip N1 in the sheet conveyance direction. The comparative image reading unit further includes a trailing-edge detector and a sheet length detector. The trailing-edge detector detects the trailing end of original documents at a position downstream from the separation nip N1 and upstream from the leading-edge detector in the sheet conveyance direction. The sheet length detector detects whether originals set on the document table is greater than a predetermined length (hereinafter "predetermined detection length D1") that is the sum of the length of a frequently used sheet size (specific sheet size), for example, letter size placed sideways or A4 size placed sideway, in the sheet conveyance direction and a margin.

When the length in the sheet conveyance direction of original documents set on the document table is smaller than the predetermined detection length D1, detection by the leading-edge detector triggers feeding of the subsequent sheet. By contrast, when the length in the sheet conveyance direction of original documents is greater than the predetermined detection length D1, detection by the trailing-edge detector triggers feeding of the subsequent sheet. The leading-edge detector is disposed at a positioned where the distance from the separation nip N1 in the document conveyance route equals the sum of the length of the specific sheet size (sheet length SL1) and a necessary margin. The trailing-edge detector is disposed at a position not to face the subsequent sheet projecting downstream from the separation nip N1 in the sheet conveyance direction although it is close to the separation nip N1 similarly to the above-described typical configurations.

In the case of the specific sheet size, the sheet length detector determines that the size in the sheet conveyance direction is smaller than the predetermined detection length D1. Accordingly, feeding of the subsequent sheet is started when the leading-edge detector detects the leading edge of the preceding sheet. Because the leading-edge detector is disposed at the position where the distance from the separation nip N1 in the document conveyance route equals the sum of the sheet length SL1 in the sheet conveyance direction and the necessary margin as described above, in the case of the specific sheet size, the leading-edge detector detects the leading edge of that sheet immediately after the trailing end of the preceding sheet exits from the separation nip N1. With this control, feeding of the subsequent sheet can be started immediately after the trailing end of the preceding sheet exits from the separation nip N1, thus reducing intervals between sheets in sequential conveyance of original documents having the sheet length SL1.

By contrast, in the case of original documents larger than the predetermined length detected by the sheet length detector, that is, longer than the specific sheet size, feeding of the subsequent sheet is started when the trailing-edge detector detects the trailing end of the original. In the case of original documents larger than the specific sheet size in the sheet conveyance direction, if feeding of the subsequent sheet is triggered by detection by the leading-edge detector, it is possible that the subsequent sheet is forwarded by the pickup roller to the separation nip N1 before the preceding sheet exits from the separation nip N1, resulting in multifeed. Therefore, in the case of original documents larger than the specific sheet size in the sheet conveyance direction, multifeed in sequential sheet conveyance can be inhibited by starting feeding the subsequent sheet when the trailing-edge detector detects the trailing end of the preceding sheet.

In the comparative document reading device, also in the case of original documents sufficiently smaller than the specific sheet size (smaller than the predetermined detection length D1) in the sheet conveyance direction, feeding of the subsequent sheet is started when the leading-edge detector detects the leading edge of the preceding sheet. In this method, however, the productivity is reduced compared with the typical method in which feeding of the subsequent sheet is triggered by detection by the trailing-edge detector. Studying this inconvenience, the inventors of the present invention have found the following. Because originals smaller than the specific sheet size in the sheet conveyance direction is shorter than the length of the document conveyance route from the trailing-edge detector to the leading-edge detector, the trailing end of the original passes by the trailing-edge detector before the leading edge thereof passes by the leading-edge detector.

The above-described inconvenience occurs in not only ADFs but also any sheet conveyance unit that picks up and transports sheets one by one from a sheet container capable of containing multiple sheets.

In view of the foregoing, it is preferred to reduce intervals between sheets in sequential conveyance of the specific size sheets that are slightly smaller than the predetermined detection length D1 in the sheet conveyance direction, and simultaneously, to restrict increases in intervals between sheets in sequential conveyance of sheets substantially smaller than the specific size.

Therefore, in the present embodiment, detection by the trailing-edge detector S3 triggers feeding of the subsequent sheet when originals smaller than the specific size sheets (sheet length SL1) are fed.

Distinctive features of the present embodiment are described in further detail below.

FIG. 8 is a schematic view of the document set section A, the separation section B, the registration section C, and a part of the turning section D of the ADF.

As shown in FIG. 8, the ADF 51 according to the present embodiment includes the pickup start detector S1 serving as a first leading-edge detector to detect the leading edge of the original document MS. The ADF 51 further includes the descent start detector S2 positioned upstream from the pickup start detector S1 in the sheet conveyance direction, serving as a second leading-edge detector to detect the leading edge of the original document MS. In addition, the sheet length detector S4 that serves as a specific size detector is provided to determine whether the size of the original documents MS set on the document table 53 is the specific size. In the present embodiment, sheet conveyance is controlled to enhance productivity in conveyance the specific size sheets (sheet length SL1), that is, a frequently used sheet size (e.g., sideways letter-size or sideways A4-size sheets), productively of which is expected to increase.

The sheet length detector S4 is positioned not to detect the specific sheet size. More specifically, the sheet length detector S4 is disposed downstream from a reference position (hereinafter "document set position") for the leading end of the original documents MS set on the document table 53 in the sheet conveyance direction, and the distance between the sheet length detector S4 and the document set position equals the sum of the sheet length SL1 (216 mm in the case of sideways letter size) and a margin a in view of variations in detection, that is, detection capability and mechanical tolerance of the detector, typically. In other words, the margin a can be such a smallest value that the specific size sheet is surely outside the detection area of the sheet length detector S4 in the above-described state. It is to be noted that the specific sheet size is not limited to "sideways letter size" but can be set according to the needs of users.

The pickup start detector S1 serving as the first leading-edge detector is disposed downstream from the trailing-edge detector S3 a distance L3 (shown in FIG. 8) that is smaller than the specific sheet size (L3<SL1) and downstream from the pickup roller 80 (first conveyance member) a distance L4 (shown in FIG. 9A) that is longer than the specific sheet size SL1 (L4>SL1) in the sheet conveyance direction. Similarly, the descent start detector S2 serving as the second leading-edge detector is disposed downstream from the trailing-edge detector S3 a distance L3' (shown in FIG. 8) that is smaller than the specific sheet size (L3'<SL1) and downstream from the pickup roller 80 (first conveyance member) a distance L4' (shown in FIG. 9A) that is longer than the specific sheet size SL1 (L4'>SL1) in the sheet conveyance direction.

The pickup start detector S1 (first leading-edge detector) is positioned so that, when the pickup start detector S1 detects the leading edge of the specific sheet size, it is certain that the trailing end of that sheet has exited from the separation nip N1 (contact range between the conveyance belt 84 and the reverse roller 85). More specifically, the pickup start detector S1 is disposed downstream in the sheet conveyance direction from the separation nip N1 by a distance L5 (shown in FIGS. 9A and 9B) equal to the sum of the sheet length SL1 in the sheet conveyance direction and a necessary margin. For example, because it is possible that the leading edge of the subsequent sheet projects downstream from the separation nip N1, the margin added to the sheet length SL1 includes the projection amount. Further, the margin is decided in view of variations in detection by the pickup start detector S1.

The descent start detector S2 (second leading-edge detector) is positioned so that, when the descent start detector S2 detects the leading edge of the specific size sheet having the sheet length SL1, it is certain that the trailing end of that sheet has exited from a portion where the pickup roller 80 contacts the sheet. More specifically, the descent start detector S2 is disposed downstream in the sheet conveyance direction from the pickup roller 80 by the distance equal to the sum of the sheet length SL1 in the sheet conveyance direction and a necessary margin. For example, the margin is decided in view of variations in detection by the descent start detector S2.

In the present embodiment, for example, the pickup start detector S1, the descent start detector S2, and the trailing-edge detector S3 are reflective photosensors that transmit ON signals to the controller 100 while detecting the original document MS and transmit OFF signals to the controller 100 when not detecting it. When the pickup start detector S1 or the descent start detector S2 outputs the ON signal, the controller 100 deems that the leading edge of the original document MS is detected. In a configuration in which switching from OFF signal to ON signal is monitored, if the controller 100 misses the switching timing from OFF signal to ON signal due to processing delay, it is possible that the subsequent processing is not executed. By contrast, in the configuration in which whether the output signal is the ON signal or the OFF signal is monitored and the controller 100 deems that the leading edge of the original document MS is detected while the ON signal is output, the subsequent processing can be executed with a delay even if switching from OFF signal to ON signal is missed.

Further, taking into account sheets with holes, such as punched sheets, the controller 100 deems that the trailing end of the original document MS is detected if the trailing-edge detector S3 keeps outputting the OFF signal for a given period while the original document MS is transported a predetermined amount. More specifically, in detecting the trailing end of the original document MS, it is necessary to determine whether the OFF signal is output before the original document MS reaches the trailing-edge detector S3 or after it exits from the detection position. In this case, the OFF signal output after the original document MS passes by the trailing-edge detector S3 can be detected by monitoring whether the OFF signal is continuously output while the original document MS is transported the predetermined amount from when the signal output from the trailing-edge detector S3 is switched from ON signal to OFF signal.

However, it is possible that the subsequent processing is not executed if the controller 100 misses the switching timing to OFF signal due to processing delay. Therefore, after the signal output from the trailing-edge detector S3 is switched to the ON signal, the controller 100 monitors whether the OFF signal is output. When the controller 100 detects that the OFF signal is output from the trailing-edge detector S3, the controller 100 then detects the amount by which the original document MS is transported based on the drive signal of the feed motor (i.e., pulse count) and monitors whether the OFF signal is continuously output while the original document MS is transported the predetermined amount. The subsequent processing can be executed with a delay even if switching from ON signal to OFF signal is missed due to processing delay. If the output from the trailing-edge detector S3 changes to ON signal while the original document MS is transported the predetermined amount, the controller 100 again monitors whether the OFF signal is continuously output from the trailing-edge detector S3 while the original document MS is transported the predetermined amount.

In the sheet conveyance control according to the present embodiment, the timing at which descending the pickup roller 80 is started and the timing at which feeding of the subsequent sheet is started are different depending on the size of original documents in the sheet conveyance direction.

Control of feeding original documents is described below for each of specific sheet size having the sheet length SL1, a sheet length SL2 smaller than the sheet length SL1 (sufficiently shorter than the predetermined detection length D1), a sheet length SL3 further smaller than the sheet length SL1 (SL3<SL2), and a sheet length SL4 larger than the specific sheet size.

Figure 9A:
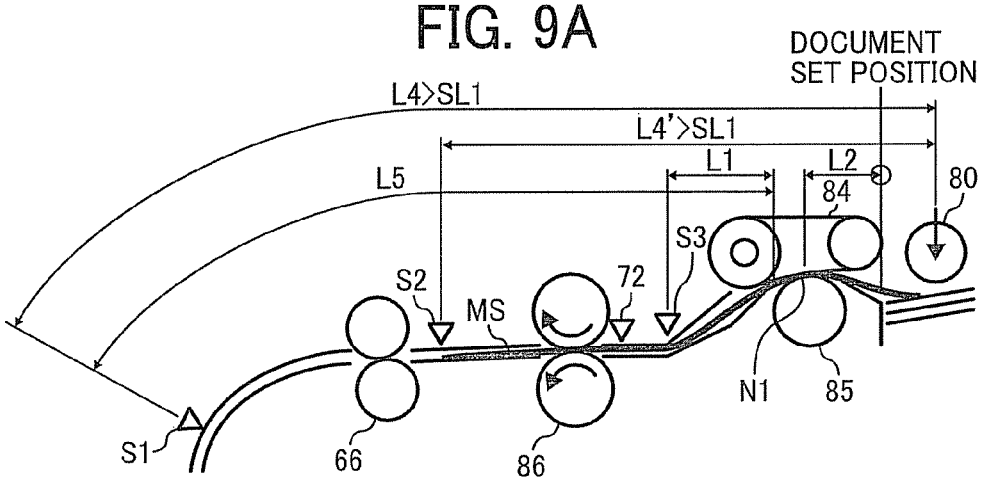
FIGS. 9A and 9B illustrate conveyance of a bundle of specific size sheets (sheet length SL1) that is slightly shorter than a predetermined detection length.
Figure 9B:
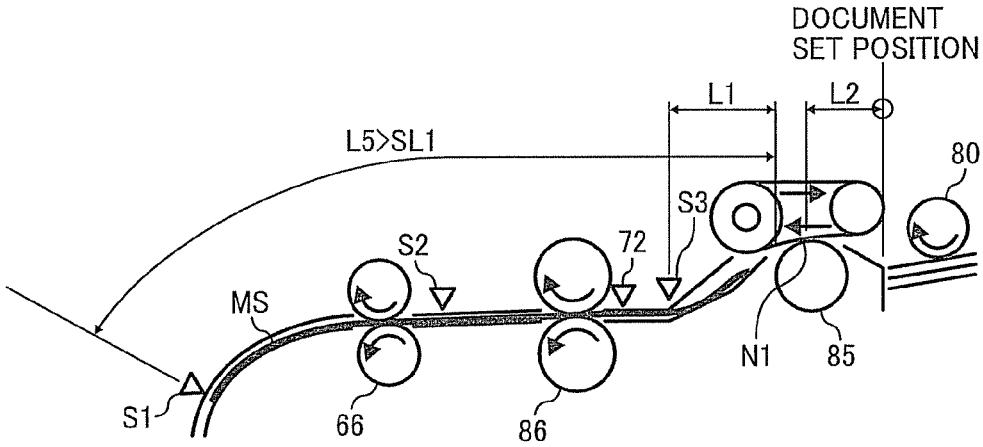

FIGS. 9A and 9B illustrate conveyance of original documents MS having the sheet length SL1 slightly smaller than the predetermined detection length D1 by the sheet length detector S4. In FIGS. 9A and 9B, reference characters L1 represents the distance from the separation nip N1 to the trailing-edge detector S3, L2 represents the distance from the document set position to the separation nip N1, L4 represents the distance from the pickup roller 80 to the descent start detector S2, and L4' represents the distance from the pickup roller 80 to the pickup start detector S1.

When the bundle of specific size original documents MS (sheet length SL1) is set on the document table 53, the sheet length detector S4 does not detect the presence of the original documents MS. Referring to FIG. 9A, in the case of the specific size original document MS having the sheet length SL1, the leading edge thereof reaches the descent start detector S2 (second leading-edge detector) before the trailing end thereof passes by the trailing-edge detector S3. At that time, as shown in FIG. 9A, the trailing end of the original document MS is positioned downstream from the position facing the pickup roller 80 in the sheet conveyance direction. Accordingly, in the case of the specific sheet size, even if the descending the pickup roller 80 is initiated when the descent start detector S2 detects the leading edge of the original document MS, the pickup roller 80 does not contact the preceding sheet. Accordingly, intervals between the specific size original documents MS having the sheet length SL1 can be reduced by starting descending the pickup roller 80 when the descent start detector S2 detects the leading edge of the original document MS compared with a method in which descending the pickup roller 80 is started when the trailing-edge detector S3 detects the trailing end of the original document MS.

Further, referring to FIG. 9B, the leading edge of the specific size original document MS reaches the pickup start detector S1 before the trailing end thereof passes by the trailing-edge detector S3. At that time, the trailing end of the original document MS is positioned slightly downstream from the separation nip N1. More specifically, the trailing end of the original document MS is at a position not to overlap with the leading edge of the subsequent sheet even if the leading edge of the subsequent sheet projects from the separation nip N1. Therefore, in the case of the specific sheet size, multifeed does not occur even if feeding of the subsequent sheet is started when the pickup start detector S1 detects the leading edge of the original document MS. Moreover, intervals between sheets can be reduced compared with the method in which feeding of the subsequent sheet is started when the trailing-edge detector S3 detects the trailing end of the original document MS.

Figure 10:
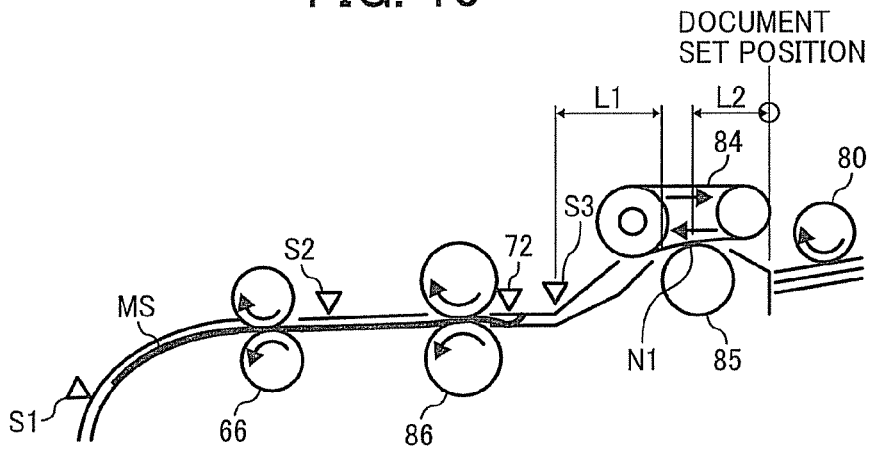
FIG. 10 illustrates conveyance of a bundle of originals substantially smaller than the predetermined detection length in the sheet conveyance direction.

FIG. 10 illustrates conveyance of original documents MS (sheet length SL2) that are smaller than the specific sheet size, that is, sufficiently smaller than the predetermined detection length D1 by the sheet length detector S4, in the sheet conveyance direction.

When the bundle of original documents MS having sheet length SL2 smaller than the specific sheet size is set on the document table 53, the sheet length detector S4 does not detect the original documents MS similarly. In conveyance of the original documents MS smaller than the specific sheet size, as shown in FIG. 10, before the leading edge of the original document MS reaches the pickup start detector 51, the trailing end thereof passes by the trailing-edge detector S3. Therefore, in the case of the original documents MS smaller than the specific sheet size, intervals between sheets can be reduced by starting feeding the subsequent sheet when the trailing-edge detector S3 detects the trailing edge of the original document MS compared with the method in which feeding of the subsequent sheet is started when the pickup start detector 51 detects the leading end thereof.

Figure 11:
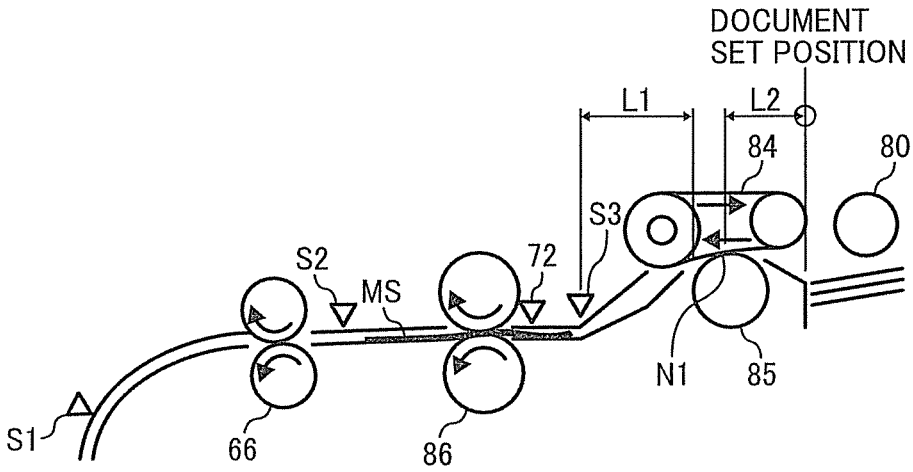
FIG. 11 illustrates conveyance of a bundle of originals smaller than that shown in FIG. 10 in the sheet conveyance direction.

FIG. 11 illustrates conveyance of original documents MS having sheet length SL3 smaller than that shown in FIG. 10 (significantly smaller than the predetermined detection length D1) in the sheet conveyance direction.

When the bundle of original documents MS smaller than the sheet shown in FIG. 10 is set on the document table 53, the sheet length detector S4 does not detect the original documents MS similarly. When the original documents MS having the sheet length SL3 are fed, before the leading edge of the original document MS reaches the descent start detector S2, the trailing end thereof passes by the trailing-edge detector S3. In such a case, intervals between sheets are increased if descending the pickup roller 80 is started when the descent start detector S2 detects the leading edge of the original document MS and feeding of the subsequent sheet is started when the pickup start detector S1 detects the leading edge of the original document MS similarly to the control of the specific sheet size. Therefore, in this case, descending the pickup roller 80 is started when the trailing-edge detector S3 detects the trailing end of the original document MS, and feeding of the subsequent sheet is started when the pickup roller 80 comes into contact with the subsequent sheet placed on the document table 53. In this way, intervals between sheets can be reduced compared with the method in which descending the pickup roller 80 and the feeding of the subsequent sheet are started based on detection by descent start detector S2 and the pickup start detector S1, respectively.

Figure 12:
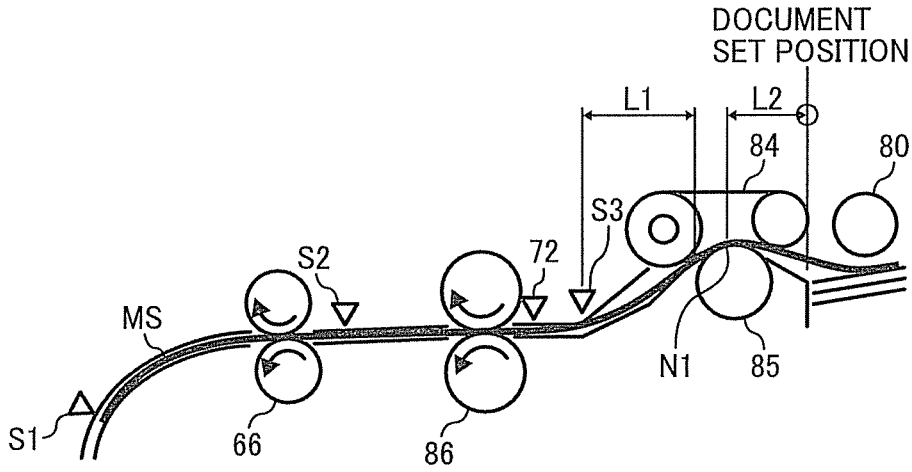
FIG. 12 illustrates conveyance of a bundle of originals that are substantially greater than the predetermined detection length in the sheet conveyance direction in the ADF shown in FIG. 8.

FIG. 12 illustrates conveyance of original documents MS having sheet length SL4 sufficiently longer than the specific sheet size in the sheet conveyance direction.

When the bundle of original documents MS larger than the specific sheet size is set on the document table 53, the sheet length detector S4 detects the original documents MS.

In this case, as shown in FIG. 12, the trailing end of the original document MS is positioned upstream from the position facing the pickup roller 80 when the leading edge thereof passes by the pickup start detector S1. Accordingly, if the descending the pickup roller 80 is initiated when the descent start detector S2 detects the leading edge of the original document MS similarly to the specific sheet size, the pickup roller 80 contacts the preceding sheet. As a result, the pickup roller 80 can hinder conveyance of the preceding sheet, skewing the preceding sheet. Moreover, if sheet conveyance is started when the pickup start detector S1 detects the leading edge of the original document MS, multifeed can occur. Therefore, in the case of original documents MS greater than the specific sheet size, descending the pickup roller 80 is started when the trailing-edge detector S3 detects the trailing end of the original document MS, and the subsequent sheet is fed when the pickup roller 80 contacts the bundle of original documents MS. With this control, original documents MS can be fed without skewing or multifeed.

Next, a control flow of the subsequent sheet in the present embodiment is described in further detail below with reference to FIGS. 13A and 13B.

Figures 13, 13A:
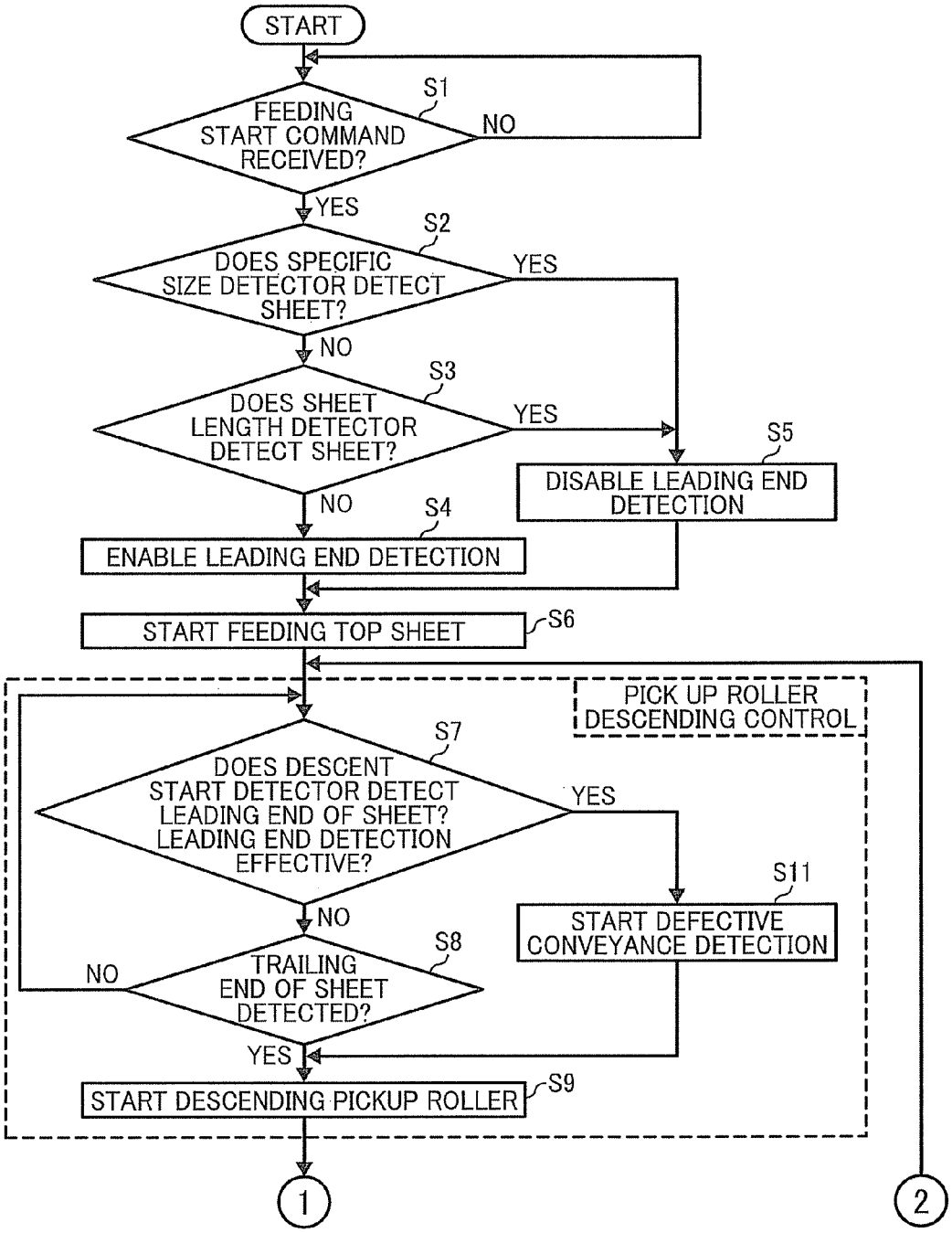
FIGS. 13A and 13B are flowcharts of a control flow of conveyance of subsequent sheets.

Referring to FIG. 13A, at S1, the controller 100 determines whether a feeding start command is received from the main body controller 111 via the I/F 107. When the feeding start command is received (Yes at S1), at S2 the controller 100 checks output from the sheet length detector S4. When the sheet length detector S4 detects the presence of the original document (Yes at S2), the controller 100 deems that the original documents set on the document table 53 are larger than the specific sheet size and cancels sheet conveyance control based on detection of the leading edge of the original document at S5.

By contrast, when the sheet length detector S4 does not detect the original document (No at S2), at S3 the controller 100 checks whether the sheet length detector 57, 58*a*, or 58*b* (shown in FIG. 5), disposed upstream from the sheet length detector S4 in the sheet conveyance direction, detects the original document. Because a bundle of original documents that are once folded and have folded marks may be set on the document table 53, the sheet length detector 57, 58*a*, or 58*b*, disposed upstream from the sheet length detector S4 in the sheet conveyance direction, is used. In this case, the folded portion of the bundle may be float above the document table 53. When the floating folded portion is positioned to face the sheet length detector S4, the sheet length detector S4 might fail to detect that original document. As a result, the controller 100 might erroneously deem that a bundle of original documents placed on the document table 53 is shorter than the specific sheet size in the sheet conveyance direction although it actually is longer than the specific sheet size. To avoid such erroneous detection, the original document is detected by the sheet length detectors 57, 58*a*, and 58*b* positioned upstream from the sheet length detector S4 in the sheet conveyance direction.

When the sheet length detector 57, 58*a*, or 58*b* detects the presence of the original document (Yes at S3), the controller 100 deems that the original documents set on the document table 53 are larger than the specific sheet size and cancels sheet conveyance control based on detection of the leading edge of the original document at S5. By contrast, when the sheet length detector 57, 58*a*, or 58*b* does not detect the original document (No at S3), the controller 100 deems that the original documents set on the document table 53 are smaller than the specific sheet size and enables sheet conveyance control based on detection of the leading edge of the original document (hereinafter also simply "leading end detection") at S4.

Thus, in the present embodiment, detection results generated by the sheet length detectors 57, 58*a*, and 58*b* are also considered in determining whether the bundle of original documents set on the document table 53 is smaller than the specific sheet size in the sheet conveyance direction. Accordingly, even if the original documents have folded marks, the controller 100 can determine whether they are smaller than the specific sheet size properly.

After sheet conveyance control based on the leading end detection is thus enabled or disabled, at S6 the pickup roller 80 starts feeding the top sheet of the bundle set on the document table 53.

At S7, the descent start detector S2 detects the leading edge of the original document, and the controller 100 checks whether the leading end detection is effective. If the original document is longer than the specific sheet size in the sheet conveyance direction, it is possible that the trailing end thereof is positioned upstream from the pickup roller 80 in the sheet conveyance direction when the descent start detector S2 detects the leading edge thereof as described above and shown in FIG. 12. Therefore, in this case, the leading end detection is disabled (No at S7). When the trailing-edge detector S3 detects the trailing end of the original document (Yes at S8), at S9 descending the pickup roller 80 is started. More specifically, the controller 100 monitors whether the OFF signal is continuously output from the trailing-edge detector S3 while the original document is transported the predetermined amount. When the OFF signal is kept while the original document is transported the predetermined amount, the controller 100 determines that the trailing end of the original document has detected, deeming that the trailing end thereof has passed by the trailing-edge detector S3. With this operation, the pickup roller 80 can be prevented from contacting the preceding sheet, and the preceding sheet can be prevented from skewing. When the pickup roller 80 contacts the subsequent sheet in the bundle of original documents, that is, after descending the pickup roller 80 is completed (Yes at S13), the controller 100 rotates the feed motor 102 in the forward direction, thus rotating the pickup roller 80 and the conveyance belt 84 to start feeding the subsequent sheet at S14. With this operation, multifeed can be prevented in conveyance of the original documents longer than the specific sheet size in the sheet conveyance direction. Whether descending the pickup roller 80 is completed can be determined using known methods based on the time elapsed after the pickup elevation motor 101 starts driving, detection by sensors, or the combination thereof, for example.

By contrast, when the leading end detection is enabled (Yes at S7), at S8 the trailing-edge detector S3 is monitored in addition to the descent start detector S2. More specifically, the controller 100 monitors whether the trailing-edge detector S3 outputs the OFF signal continuously while the original document is transported the predetermined amount and monitors whether the descent start detector S2 outputs the ON signal. When OFF signal from the trailing-edge detector S3 is kept while the original document is transported the predetermined amount (Yes at S8), that is, the trailing-edge detector S3 detects the trailing end of the original document, or when the descent start detector S2 outputs the ON signal, that is, the descent start detector S2 detects the leading edge of the original document (Yes at S7), at S9 the pickup roller 80 starts descending. In the case of original documents MS shown in FIG. 11, shorter than the specific size, before the descent start detector S2 detects the leading edge of the original document, the trailing-edge detector S3 detects the trailing end thereof. Therefore, in the case of smaller original documents shown in FIG. 11, the detection result generated by the trailing-edge detector S3 triggers descending the pickup roller 80. When the pickup roller 80 contacts the subsequent sheet in the bundle of original documents, that is, after descending the pickup roller 80 is completed (Yes at S13), the controller 100 rotates the feed motor 102 in the forward direction, thus rotating the pickup roller 80 and the conveyance belt 84 to start feeding the subsequent sheet at S14. This operation can restrict increases in intervals between sheets in conveyance of the original documents substantially shorter than the specific sheet size, the original document MS shown in FIG. 11.

Figure 15:
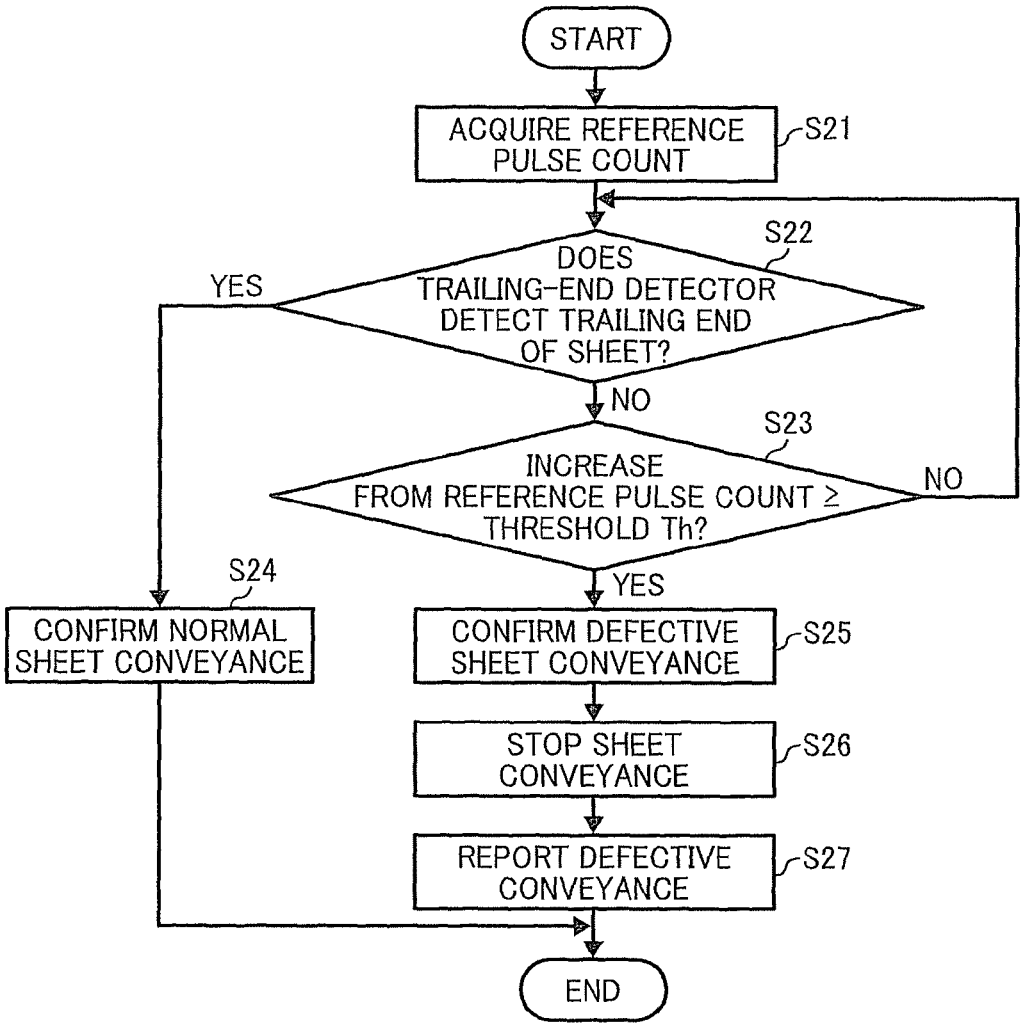
FIG. 15 is a flowchart of defective conveyance detection.

By contrast, in the case of specific sheet size or the sheet size shown in FIG. 10, before the trailing-edge detector S3 detects the trailing end of the original document, the descent start detector S2 detects the leading edge thereof (Yes at S7). Therefore, in the case of the specific sheet size or such a size as shown in FIG. 10, the detection result generated by the descent start detector S2 triggers descending the pickup roller 80 at S9. In addition, if the descent start detector S2 detects the leading edge of the original document before the trailing-edge detector S3 detects the trailing end thereof, at S11 defective conveyance detection, described later with reference to FIG. 15, is initiated.

When the descent start detector S2 detects the leading edge of the original document before the trailing-edge detector S3 detects the trailing end thereof, the controller 100 monitors the pickup start detector S1 at S10 and the trailing-edge detector S3 at S12. More specifically, the controller 100 monitors whether the trailing-edge detector S3 outputs the OFF signal continuously while the original document is transported the predetermined amount and monitors whether the pickup start detector S1 outputs the ON signal. When OFF signal from the trailing-edge detector S3 is kept while the original document is transported the predetermined amount (Yes at S12), that is, the trailing-edge detector S3 detects the trailing end of the original document, or when the pickup start detector S1 outputs the ON signal, that is, the pickup start detector S1 detects the leading edge of the original document (Yes at S10), at S14 the controller 100 starts feeding the subsequent sheet. In the case of sheet size shown in FIG. 10, shorter than the specific sheet size, before the pickup start detector S1 detects the leading edge of the original document (No at S10), the trailing-edge detector S3 detects the trailing end thereof (Yes at S12). Therefore, in the case of sheet size shown in FIG. 10, smaller than the specific sheet size, the detection result generated by the trailing-edge detector S3 is used as the trigger, and, after descent of the pickup roller 80 is completed at S13, feeding of the subsequent sheet is started at S14. This operation can reduce intervals between sheets in conveyance of the original documents shown in FIG. 10, sufficiently smaller than the specific sheet size, compared with the method in which the detection result generated by the pickup start detector S1 triggers feeding of the subsequent sheet.

By contrast, in the case of the specific sheet size, as shown in FIG. 9B, before the trailing-edge detector S3 detects the trailing end of the original document, the pickup start detector S1 detects the leading edge of the original document (Yes at S10). Therefore, in the case of the specific sheet, the detection result generated by the pickup start detector S1 is used as the trigger. Since descending the pickup roller 80 is typically completed (Yes at S13) before the pickup start detector S1 detects the leading edge of the original document, feeding of the subsequent sheet is started when the pickup start detector S1 detects the leading edge of the original document at S14. This operation can reduce intervals between sheets in conveyance of the original documents of the specific sheet size compared with the method in which the detection result generated by the trailing-edge detector S3 triggers feeding of the subsequent sheet. In addition, when the pickup start detector S1 detects the leading edge of the original document before the trailing-edge detector S3 detects the trailing end thereof, at S17 defective conveyance detection, described later with reference to FIG. 15, is initiated.

In addition, if any subsequent sheet remains (Yes at S15), the step of S7 and subsequent steps are repeated after the trailing-edge detector S3 outputs the ON signal, that is, the trailing-edge detector S3 detects the leading edge of the original document (Yes at S16). Thus, by performing the step of S7 and subsequent steps after it is confirmed that the signal output from trailing-edge detector S3 is switched to the ON signal, the controller 100 can determine whether the trailing-edge detector S3 has detected the trailing end of the original document by simply monitoring whether the trailing-edge detector S3 has output the OFF signal continuously for the predetermined period. This control has an advantage over the method of checking whether the OFF signal is kept for the predetermined period after the output from the trailing-edge detector S3 is changed from ON signal to OFF signal because sheet conveyance control can be executed with a delay even if the switching is missed due to processing delay.

Figure 14:
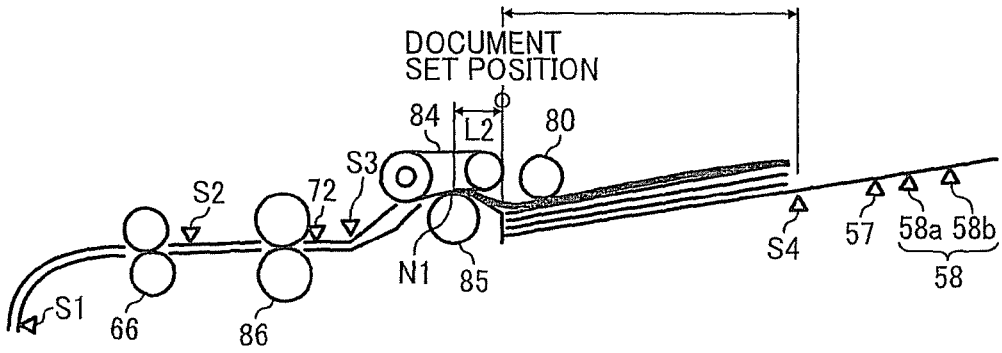
FIG. 14 illustrates movement of original documents set on the document table in sequential sheet conveyance.

In the present embodiment, regarding the second and subsequent sheets remaining on the document table 53, the sheet length detectors (S4, 57, 58*a*, and 58*b*) does not detect their length. Instead, conveyance of the subsequent sheet is controlled based on the data acquired before the first sheet (top sheet) of the bundle of original documents is fed. More specifically, it is possible that the sheets remaining on the document table 53 are dragged toward the separation nip N1 in sequential conveyance of original documents. Therefore, referring to FIG. 14, this feature is necessary for a bundle of original documents longer than the specific sheet size to the extent that the trailing end is positioned upstream from the sheet length detector S4 by the distance shorter than the distance L2 from the document set position to the separation nip N1 when it is placed on the document table 53. If remaining sheets in such bundle are dragged toward the separation nip N1, it is not detected by the sheet length detector S4 as shown in FIG. 14 although they actually are longer than the specific sheet size in the sheet conveyance direction. Accordingly, the controller 100 erroneously deems that they are shorter that the specific sheet size. As a result, despite the actual length, the leading end detection is made effective, causing multifeed or skewing.

In view of the foregoing, in the present embodiment, the length of only the top sheet of a bundle of original documents is detected by the sheet length detectors (S4, 57, 58*a*, and 58*b*), and whether the leading end detection is enabled or disabled is not changed regarding the rest of the identical bundle. Thus, multifeed and skew of sheets can be prevented.

Figure 13B:
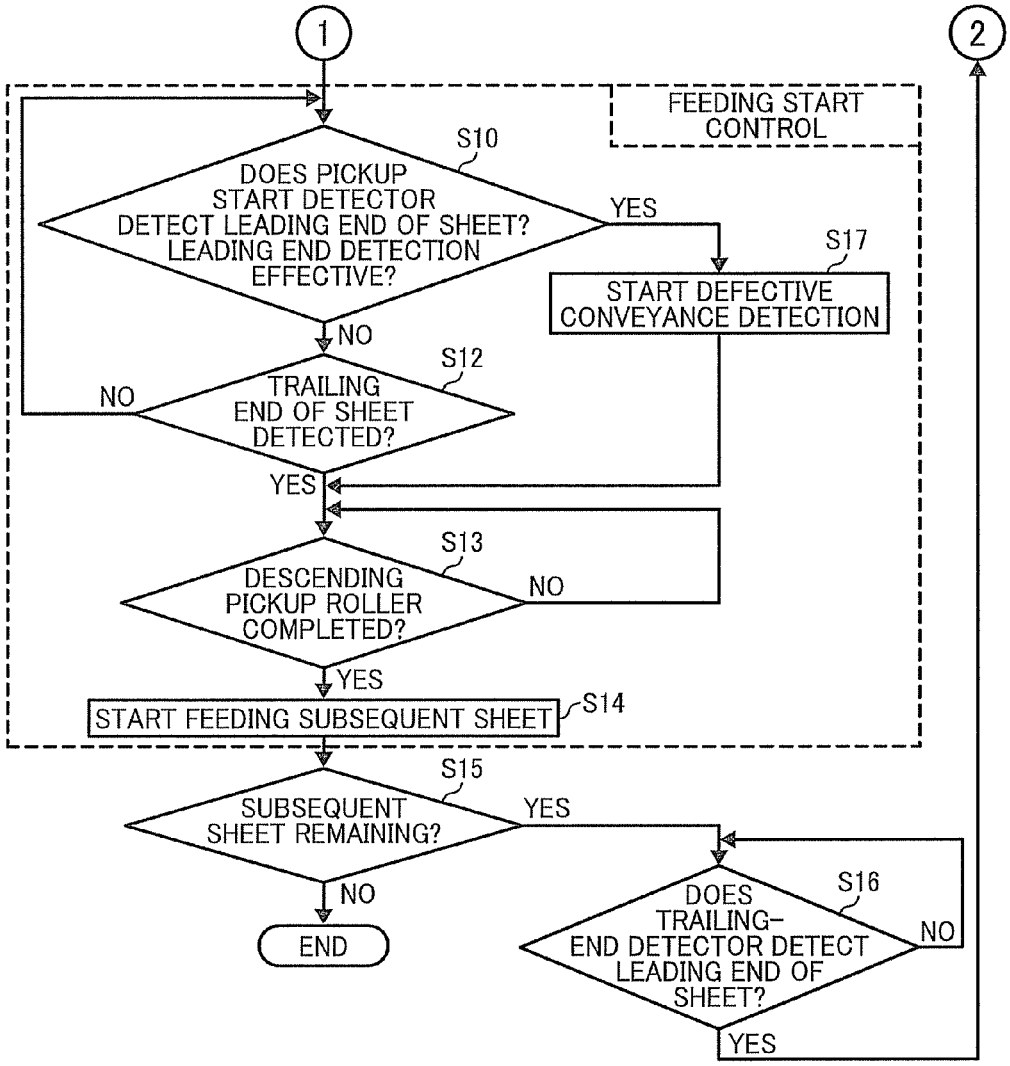

Next, defective conveyance detection in the control flow shown in FIGS. 13A and 13B is described below.

When the sheet length detector S4 does not detect the presence of original documents and the leading end detection is enabled, the trailing-edge detector S3 should detect the trailing end of the original document within a predetermined period of time after the pickup start detector S1 or the descent start detector S2 detects the leading edge thereof. If the trailing-edge detector S3 does not detect the trailing end of the original document within the predetermined period of time, it is suspected that the sheet length detector S4 does not detect the original document due to failure or malfunction although the original document longer than the specific sheet size is set on the document table 53. If the leading end detection is enabled in conveyance of original documents longer than the specific sheet size, skew or multifeed can occur as described above. Therefore, in the present embodiment, defective conveyance detection is performed to check whether original documents longer than the specific sheet size are fed although the leading end detection is enabled.

FIG. 15 is a flowchart that illustrates a sequence of operations to detect defective conveyance.

When the leading end detection is enabled and the descent start detector S2 or the pickup start detector S1 detects the leading edge of the original document, the sequence shown in FIG. 15 is invoked and performed in parallel to the processes shown in FIGS. 13A and 13B.

When the defective conveyance detection is triggered by detection of the leading edge of the original document by the descent start detector S2 or the pickup start detector S1, at S21 the pulse count at that time (i.e., current pulse count) of the driving motor (feed motor 102 or pullout motor 113) is acquired and stored as a reference pulse count in a memory of the controller 100. At S22, the controller 100 monitors the trailing-edge detector S3. If the trailing-edge detector S3 detects the trailing end of the original document before the increase in pulse count from the reference pulse count reaches the threshold Th (Yes at S22), at S24 the controller 100 deems that the document sheet conveyance is proper.

By contrast, if the trailing-edge detector S3 does not detect the trailing end of the original document (no at S22) even when the increase in pulse count from the reference pulse count acquired at S21 reaches the threshold Th (Yes at S23), at S25, the controller 100 determines that sheet conveyance is defective. That is, the controller 100 deems that the original document being fed is longer than the specific sheet size in the sheet conveyance direction although the leading end detection is enabled. In this case, because there is a risk of occurrence of multifeed or skew, at S26 the controller 100 stops the respective driving motors used in sheet conveyance to stop transporting the original document. In addition, at S27, the controller 100 reports the defective conveyance to the main body controller 111 via the I/F 107. The main body controller 111 then causes the operation panel 108 to report a possibility of malfunction of the sheet length detector S4 to users.

In a case in which the defective conveyance detection is triggered by the detection result generated by the descent start detector S2, the threshold Th is the sum of the drive pulse count of the driving motor (feed motor 102 or pullout motor 113) necessary to transport the original document from the pickup roller 80 to the detection position of the trailing-edge detector S3 and a margin in view of fluctuations in detection or the like. In a case in which the defective conveyance detection is triggered by the detection result generated by the pickup start detector S1, the threshold Th is the sum of the drive pulse count of the driving motor (feed motor 102 or pullout motor 113) necessary to transport the original document from the separation nip N1 to the detection position of the trailing-edge detector S3 and a margin.

It is to be noted that, in FIGS. 13A and 13B, although the defective conveyance detection is triggered by both the detection result by the descent start detector S2 and that by the pickup start detector S1, the defective conveyance detection may be triggered by only one of them.

Thus, the above-described defective conveyance detection can prevent feeding original documents longer than the specific sheet size when the leading end detection is effective, caused by failure or malfunction of the sheet length detector S4. As a result, occurrence of multifeed and skew can be restricted.

Further, users may place a bundle of original documents that is a mixture of specific size sheets and longer sheets on the document table 53 at a time. In that case, before the top sheet is fed, the sheet length detectors S4, 57, 58*a*, and 58*b* generate a detection result indicating that the bundle is longer than the specific sheet size in the sheet conveyance direction, and the leading end detection is disabled. In the case of mixed size sheets, it is not efficient to control feeding of the subsequent sheets based on the data acquired before the first sheet (top sheet) of the bundle is fed when the first sheet is longer than the specific sheet size and the rest is shorter than the specific sheet size. More specifically, even if the remaining sheets on the document table 53 are shorter than the specific sheet size, conveyance thereof is controlled based on the trailing end detection, reducing the productivity. Therefore, when a bundle of original documents that is a mixture of sheets of the specific sheet size and longer sheets is set on the document table 53 at a time, the image reading unit 50 may be configured to allow the user to select "mixed-size loading mode" to restrict the decrease in productivity. For example, the user can select or the cancel mixed-size loading mode on the operation panel 108

In the mixed-size loading mode, the controller 100 executes sheet size detection by the sheet length detectors (S4, 57, 58*a*, and 58*b*) each time before feeding of the subsequent sheet to determine whether the sheet on the document table 53 is longer than the specific sheet size. In this case, however, it is possible that the leading edge of the subsequent sheet is dragged by the preceding sheet toward the separation nip N1, and the sheet length detector S4 fails to detect the sheet even if it actually is longer than the specific sheet size as shown in FIG. 14.

Therefore, in the mixed-size loading mode, taking into account the situation shown in FIG. 14, when detection by the descent start detector S2 is used as the trigger for descending the pickup roller 80, descending the pickup roller 80 is started after a predetermined time has elapsed from when the descent start detector S2 detects the leading edge of the original document. In addition, when detection by the pickup start detector S1 is used as the trigger for the pickup roller 80 as well as the conveyance belt 84 to start sheet conveyance, the pickup roller 80 and the conveyance belt 84 start sheet conveyance after a predetermined time has elapsed from when the pickup start detector S1 detects the leading edge of the original document.

Figure 17A:
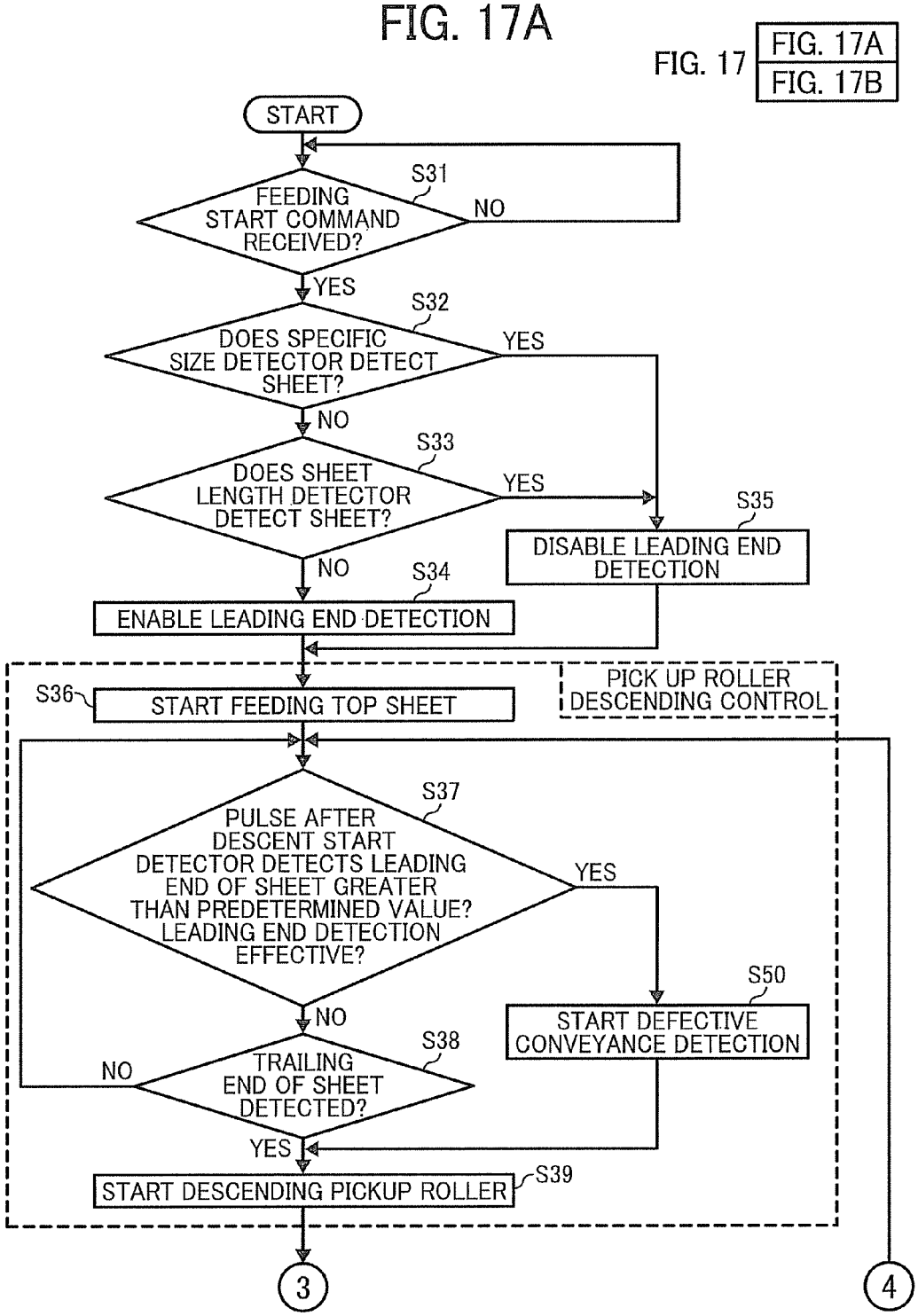
FIGS. 17A and 17B are flowcharts of control of conveyance of subsequent sheets in the mixed-size loading mode.
Figure 17B:
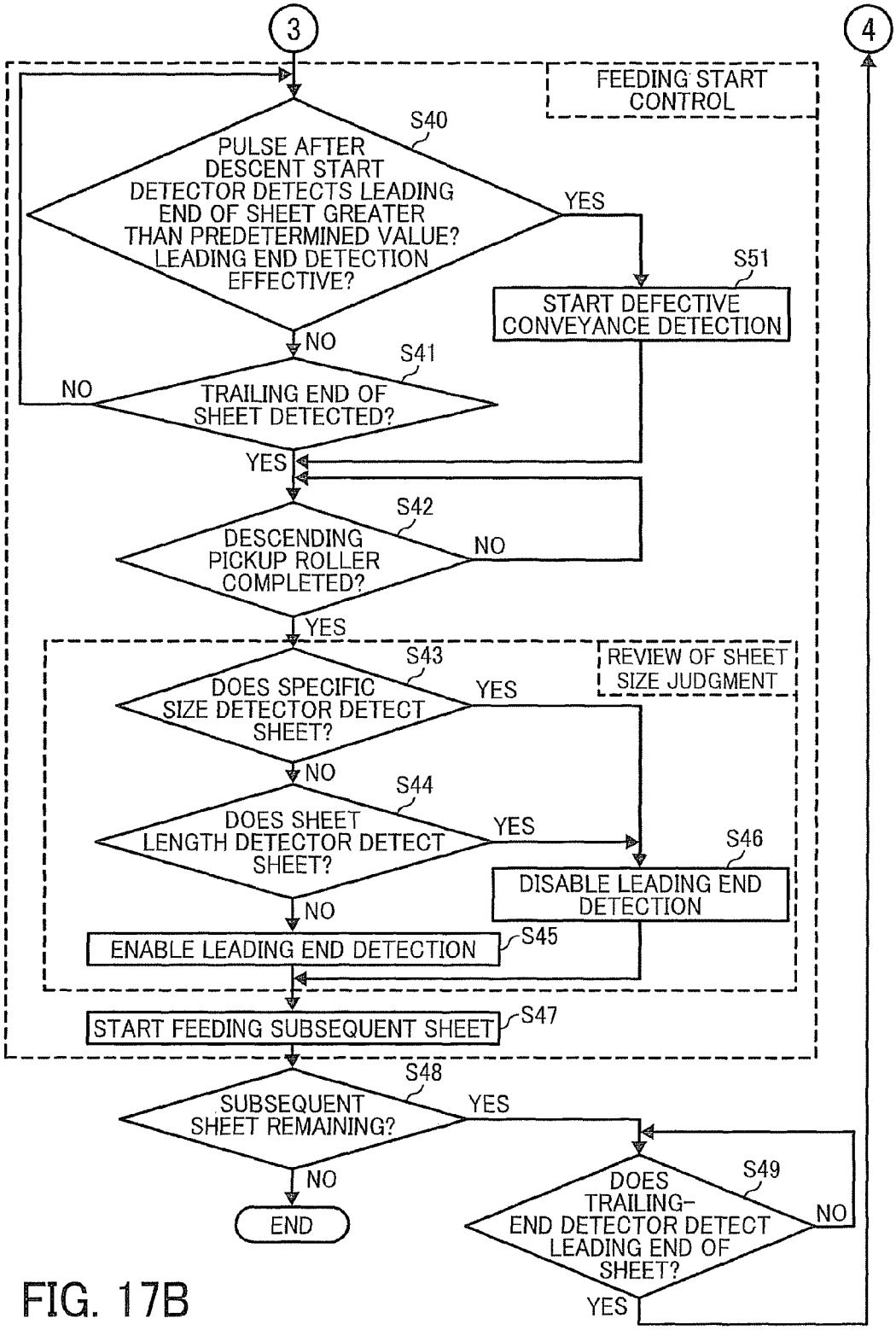

FIGS. 17A and 17B illustrate a sequence of operations in feeding subsequent sheets in the mixed-size loading mode.

Referring to FIG. 17A, at S31 through S36, operations similar to the steps S1 through S6 shown in FIGS. 13A and 13B are performed. That is, the controller 100 determines whether the bundle of original documents set on the document, table 53 is longer than the specific sheet size in the sheet conveyance direction and enables or disables the leading end detection, after which the top sheet is transported.

When the leading end detection is disabled (S35), or when the leading end detection is enabled and the driving motor (feed motor 102 or pullout motor 113) has not yet been driven for the predetermined number of pulses (hereinafter "first waiting time") after the descent start detector S2 detects the leading edge of the original document (No at S37), at S38 the controller 100 checks detection by the trailing-edge detector S3. When the trailing-edge detector S3 detects the trailing end of the original document (Yes at S38) before the pulse count reaches the threshold, at S39 descending the pickup roller 80 is triggered by the trailing end detection by the trailing-edge detector S3, similarly to the control flow shown in FIGS. 13A and 13B. After descending the pickup roller 80 is completed (Yes at S42), at S43 and S44, the controller 100 again determines whether the length of the bundle set on the document table 53 is longer than the specific sheet size based on detection results generated by the sheet length detector S4 (specific size detector) and the sheet length detectors 57, 58*a*, and 58*b*. At S45 and 46, the leading end detection is enabled or disabled. At S47, feeding of the subsequent sheet is started.

By contrast, when the leading end detection is enabled and the trailing-edge detector S3 does not detect the trailing end of the original document within the first waiting time, that is, before the number of pulses during which the driving motor (feed motor 102 or pullout motor 113) is driven reaches the predetermined number of pulses, after the descent start detector S2 detects the leading edge of the original document (Yes at S37), descending the pickup roller 80 is started after the driving motor (feed motor 102 or pullout motor 113) has been driven for the predetermined number of pulses. More specifically, when the descent start detector S2 detects the leading edge of the original document, the number of pulses in the period during which the driving motors (feed motor 102 and pullout motor 113) are driven is counted. When the trailing-edge detector S3 does not detect the trailing end of the original document before the pulse count reaches the predetermined number of pulses, descending the pickup roller 80 is started. It is to be noted that the above-described predetermined number of pulses is the amount necessary to transport the sheet a distance that is the sum of the distance L2 from the document set position to the separation nip N1 and a necessary margin $\alpha$. Alternatively, the controller 100 may check whether a period necessary for the sheet to travel the sum ($L2+\alpha$) has elapsed after the descent start detector S2 detects the leading edge of the original document, and descending the pickup roller 80 may be started when the trailing-edge detector S3 does not detect the trailing end of the original document after that period has elapsed.

In addition, when the leading end detection is enabled and the trailing-edge detector S3 does not detect the trailing end of the original document before the driving motors (feed motor 102 and pullout motor 113) are driven the predetermined number of pulses (second waiting time") after the pickup start detector S1 detects the leading edge of the original document (Yes at S40), at S47 feeding of the subsequent sheet is started after the driving motors (feed motor 102 and pullout motor 113) are driven the predetermined number of pulses. In this case, because descending the pickup roller 80 is completed when the pickup start detector S1 detects the leading edge of the original document, whether to enable or disable the leading end detection is decided, that is, review of sheet size judgment is completed, before the driving motors are driven for the predetermined number of pulses.

Figure 16:
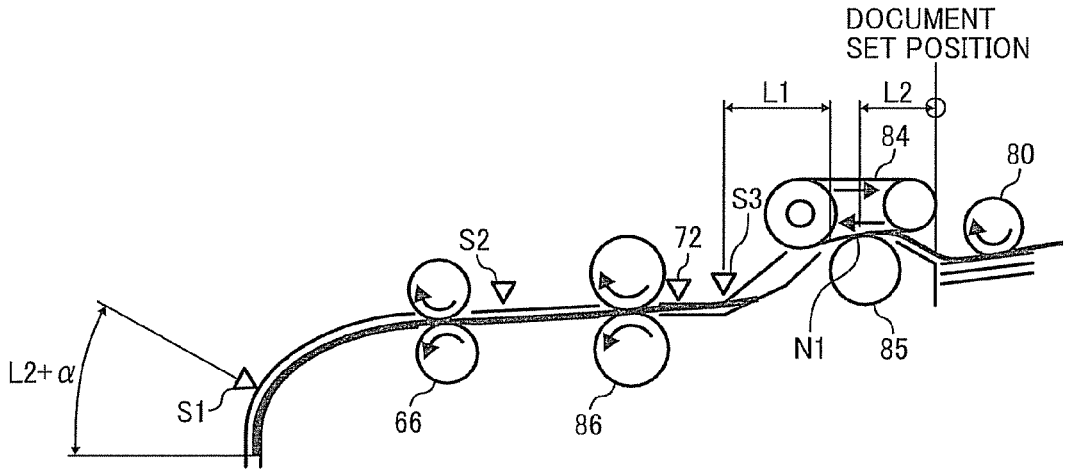
FIG. 16 illustrates sheet conveyance in a mixed-size loading mode.

The above-described mixed-size loading mode is effective when the distance L1 from the separation nip N1 to the trailing-edge detector S3 is greater than the distance L2 from the document set position to the separation nip N1 serving as the separation position ($L1>L2$). If the distance L2 is longer than the distance L1 ($L2>L1$), the trailing end of the original document can exit from the detection position by the trailing-edge detector S3 in a period of time required for the original document to travel the distance L2 after the pickup start detector S1 detects the leading edge thereof. In other words, in the configuration in which the distance L2 is longer than the distance L1, processing of a bundle of mixed size sheets can be faster by disabling the leading end detection and using the detection result generated by the trailing-edge detector S3 as the trigger for sheet conveyance. By contrast, in the configuration in which the distance L2 is shorter than the distance L1 ($L2<L1$), intervals between sheets can be reduced by the distance L1 minus the distance L2 ($L1-L2$) in the control flow shown in FIGS. 17A and 17B, compared with the case in which the detection result generated by the trailing-edge detector S3 is used as the trigger. It is to be noted that, as shown in FIG. 16, although the controller 100 waits for the period required for the original document to travel the distance ($L2+\alpha$) after the pickup start detector S1 detects the leading edge thereof, it is deemed that the trailing end of the original document is detected when the trailing-edge detector S3 does not detect it again after the predetermined time has elapsed from when the trailing-edge detector S3 stops detecting it. Therefore, a margin substantially equal to the margin $\alpha$ can be provided from when the trailing end of the original document passes by the trailing-edge detector S3 to when sheet conveyance control is started. Therefore, whether to implement the mixed-size loading mode in the system can be decided based on the comparison between the distance L1 and the distance L2, and inconveniences do not arise.

In addition, the sheet length detector S4 may be a line sensor, for example.

Figure 18:
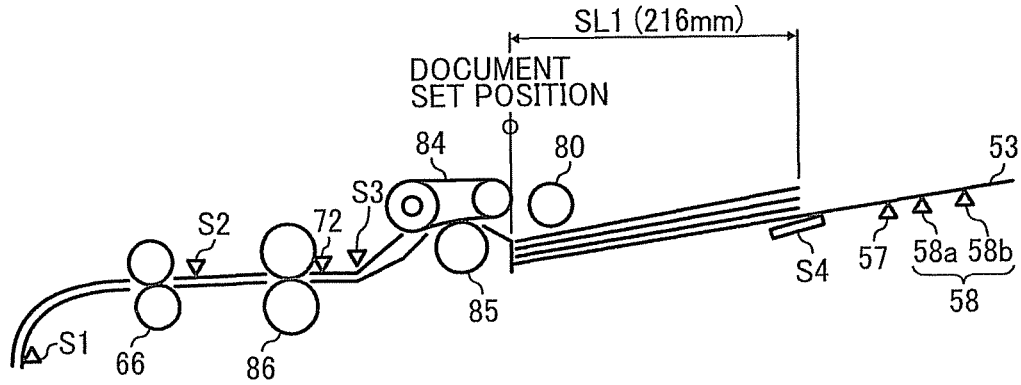
FIG. 18 is a schematic view that illustrates a configuration of a document set section, a separation section, a registration section, and a part of a turning section of an ADF in which a line sensor is used as a specific size detector.
Figure 19A:
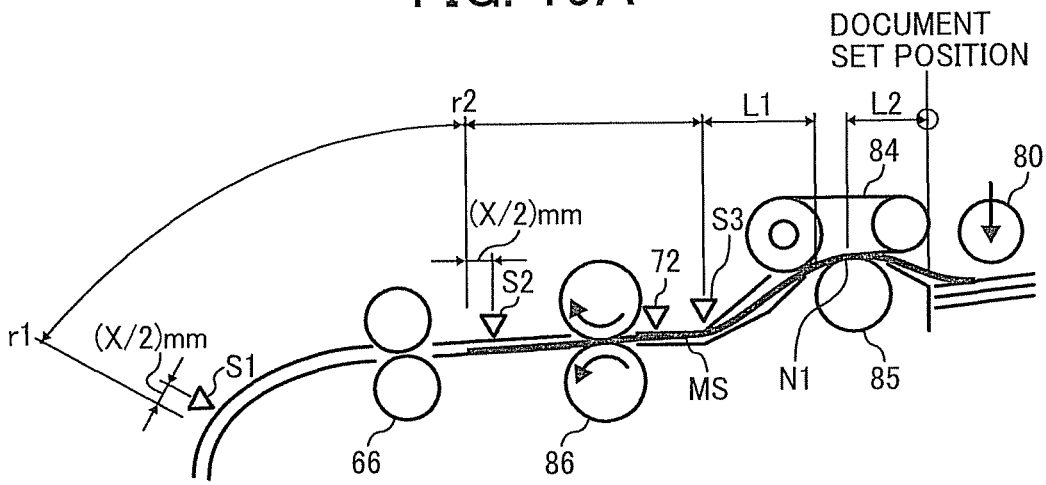
FIGS. 19A and 19B illustrate sheet conveyance of a bundle of specific size sheets (sheet length SL1) that is slightly shorter than the predetermined detection length in the configuration shown in FIG. 18.
Figure 19B:
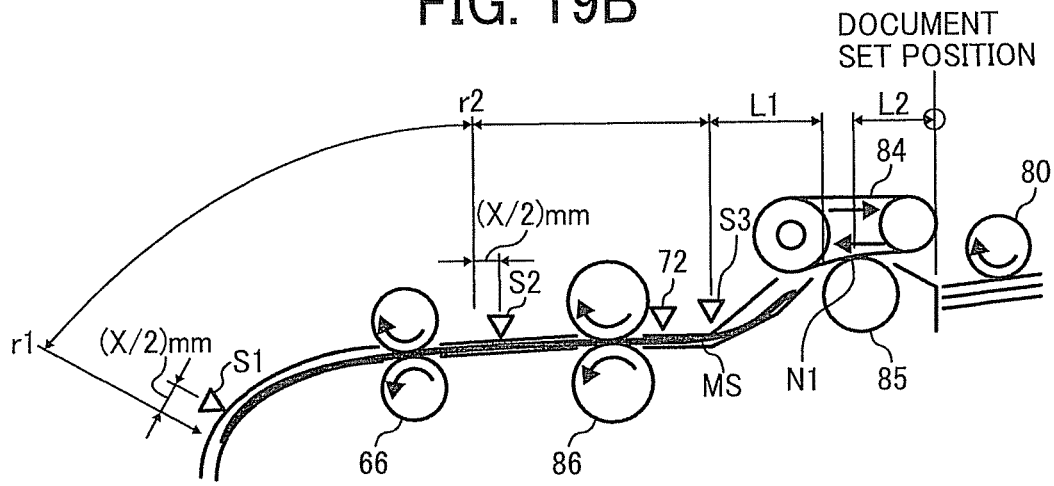

FIG. 18 is a schematic view that illustrates a configuration of the document set section, the separation section, the registration section, and a part of the turning section when a line sensor is used as the sheet length detector S4. FIGS. 19A and 19B illustrate conveyance of a bundle of specific size original documents in the configuration shown in FIG. 18.

In the configuration shown in FIGS. 18, 19A, and 19B, the sheet length detector S4 is a line sensor having an effective detection range of X mm in the sheet conveyance direction and positioned so that its center portion is aligned with a reference position that is 216 mm away from the document set position when the specific sheet size is sideways letter size, for example.

When the line sensor is used as the sheet length detector S4, the sheet length detector S4 can precisely detect the length of sheets having a length within a range of sheet length SL1±X/2 (216±X/2, in the case of sideways letter size) mm in the sheet conveyance direction.

In addition, the pickup start detector S1 (first leading-edge detector) is positioned such that it is certain that, when the pickup start detector S1 detects the leading edge of an original document having a minimum length detectable by the sheet length detector S4 (216−X/2 mm in the case of sideways letter size) in the sheet conveyance direction, the trailing end thereof has exited from the separation nip N1. More specifically, referring to FIGS. 19A and 19B, reference character r1 represents a position downstream from the separation nip N1 by a distance that is the sum of the length of the specific sheet size in the sheet conveyance direction (sheet length SL1) and the margin, and the pickup start detector S1 is positioned X/2 mm upstream from the position r1.

Similarly, reference character r2 shown in FIGS. 19A and 19B represents a position downstream from the pickup roller 80 by a distance that is the sum of the sheet length SL1 (216 mm, in the case of sideways letter size) and the margin $\alpha$, and the descent start detector S2 (second leading-edge detector) is disposed X/2 mm upstream from the position r2 in the sheet conveyance direction.

As shown in FIGS. 19A and 19B, when a bundle of original documents of the specific sheet size is set on the document table 53, the sheet length detector S4 constituted of the line sensor can accurately detect that the length of the bundle in the sheet conveyance direction equals that of the specific sheet size.

In the case of the specific sheet size, before the trailing-edge detector S3 detects the trailing end of the original document, the descent start detector S2 detects the leading edge thereof. As the descent start detector S2 is positioned X/2 mm upstream from the position r2, the trailing end of the original document has not yet exited from the contact position with the pickup roller 80. Therefore, when the descent start detector S2 detects the leading edge of the original document, counting driving pulses of the driving motor (feed motor 102 and pullout motor 113) is started. When the increase in the pulse count reaches the threshold Th for the specific sheet size, the pickup elevation motor 101 is started, thus starting descending the pickup roller 80. When the sheet length detector S4 is a line sensor, which can accurately detect the length of the original document in the sheet conveyance direction, descending the pickup roller 80 can be started reliably after the trailing end of the original document exits from the contact position with the pickup roller 80. A nonvolatile memory of the main body controller 111 stores the number of pulses (threshold Th) corresponding to sheet sizes ranging from the sheet length SL1 minus X/2 mm to the sheet length SL1 plus X/2 mm. The number of pulses corresponding to the length in the sheet conveyance direction is determined according to the detection result generated by the sheet length detector S4. For example, in the case of the original document of the specific sheet size, the number of pulses required for the specific sheet size is retrieved from the nonvolatile memory, and the main body controller 111 checks whether the increase in the pulse count of the driving motor (feed motor 102 and pullout motor 113) reaches the threshold Th.

Similarly, in the case of the specific sheet size, before the trailing-edge detector S3 detects the trailing end of the original document, the pickup start detector S1 detects the leading edge of the original document. However, as the pickup start detector S1 is positioned X/2 mm upstream from the position r1 (shown in FIGS. 19A and 19B), it is possible that the trailing end of the original document has not yet exited from the separation nip N1. Therefore, when the pickup start detector S1 detects the leading edge of the original document, counting driving pulses of the driving motor (feed motor 102 and pullout motor 113) is started. When the increase in the pulse count reaches the threshold Th for the specific sheet size, feeding of the subsequent sheet is started. With this operation, multifeed can be prevented.

Although the description above concerns feeding original documents of the specific sheet size, similar control is performed for original documents longer than the sheet length SL1 minus X/2 mm and shorter than the sheet length SL1 plus X/2 mm in the sheet conveyance direction. Further, although counting the number of pulses of the driving motor is triggered by detection result generated by the pickup start detector S1 and the descent start detector S2, the trigger for that is not limited thereto. Alternatively, for example, counting the number of pulses of the driving motor may be started by the start of driving of the pullout motor 113.

It is to be noted that, when the line sensor serving as the sheet length detector S4 does not detect the presence of the original document set on the document table 53, it means that the original document is shorter than the sheet length SL1 minus X/2 mm. In this case, similarly to the description above, the controller 100 monitors the trailing-edge detector S3 and the descent start detector S2. When the trailing-edge detector S3 detects the trailing end of the original document before the descent start detector S2 detects the leading edge thereof, descending the pickup roller 80 is triggered by the detection result by the trailing-edge detector S3. Then, feeding of the subsequent sheet is started when the pickup roller 80 contacts the subsequent sheet.

By contrast, when the descent start detector S2 detects the leading edge of the original document before the trailing-edge detector S3 detects the trailing end thereof, descending the pickup roller 80 is triggered by the detection result by the descent start detector S2. Simultaneously, the controller 100 monitors the pickup start detector S1 and the trailing-edge detector S3. Feeding of the subsequent sheet is started when the pickup start detector S1 detects the leading edge of the original document, or the trailing-edge detector S3 detects the trailing end of the original document.

Further, when the line sensor serving as the sheet length detector S4 detects a length of the sheet length SL1 plus X/2 mm, it means that the length of the bundle of original documents set on the document table 53 is equal to or greater than the sheet length SL1 plus X/2 mm. Accordingly, when the trailing-edge detector S3 detects the trailing end of the original document, the above-described sequence of processes from descending the pickup roller 80 to feeding the subsequent sheet is started.

As described above, when the line sensor is used as the sheet length detector S4, the sheet length detector S4 can precisely detect the length of sheets having a length within a range of sheet length SL1±(X/2) in the sheet conveyance direction. Accordingly, conveyance of original documents can be controlled properly based on the length thereof in sheet conveyance direction. Thus, in feeding original documents having a length within a range of sheet length SL1±(X/2) in the sheet conveyance direction, intervals between sheets can be reduced to a minimum, enhancing the productivity.

Figure 20:
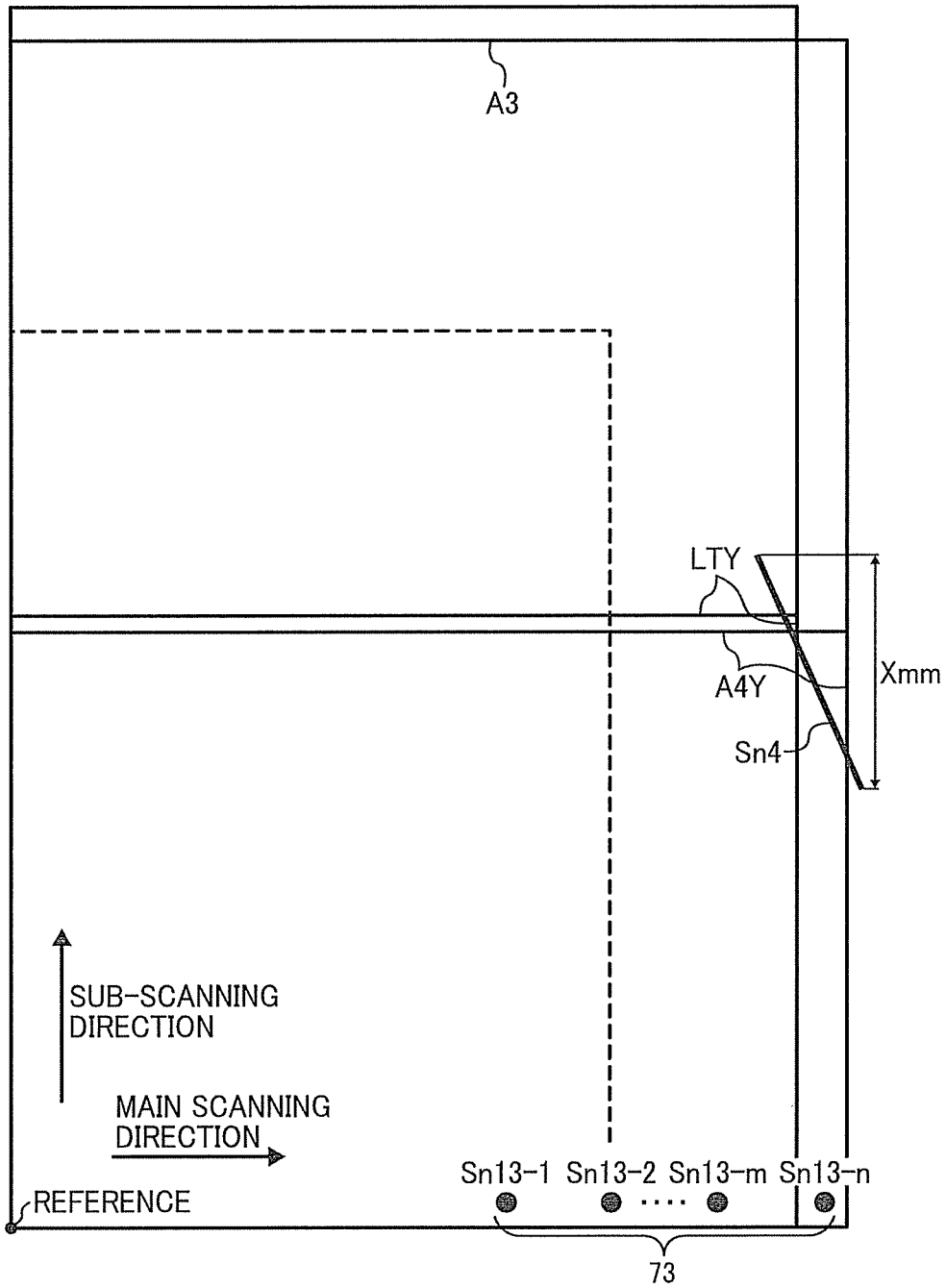
FIG. 20 illustrates a configuration in which the line sensor as the specific size detector is inclined relative to the sheet conveyance direction.

Additionally, as shown in FIG. 20, the line sensor serving as the sheet length detector S4 may be inclined relative to the sheet conveyance direction. In FIG. 20, reference characters A4Y represents sideways A4 size, LTY represents sideways letter size, and Sn13-1 to Sn13-n represent multiple reflective photosensors, arranged in the width direction of original documents (i.e., main scanning direction), that together form the document width detector 73. When the sheet length detector S4 is inclined relative to the sheet conveyance direction, the sheet length detector S4 can detect whether the width of the sheet is within a predetermined range as well, and the number of the reflective photosensors Sn13-1 to Sn13-n can be reduced.

For example, in the configuration shown in FIG. 20, the sheet length detector S4 can detect widths of sideways A4 size and sideways letter size. Accordingly, the reflective photosensor Sn13-n is not required.

Additionally, in the case of a nonstandard size, longer than the specific sheet size (e.g., LTY), indicated by broken lines shown in FIG. 20, it is possible that the sheet length detector S4 fails to detect that it is longer than the specific sheet size. Therefore, when neither the sheet length detector S4 nor the reflective photosensor Sn13-m does not detect the original document, control based on the leading end detection is canceled and the detection result generated by the trailing-edge detector S3 is used as the trigger for feeding of the subsequent sheet.

Figure 21:
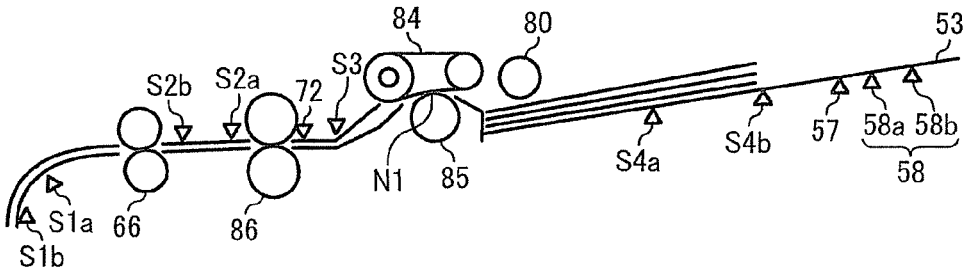
FIG. 21 illustrates conveyance of originals when a bundle of specific size sheets is set on the document table in an ADF that includes multiple specific size detectors.

In addition, as shown in FIG. 21, multiple specific size detectors (first and second sheet length detectors S4*a* and S4*b*) may be used. In this case, multiple pickup start detectors S1 (first and second pickup start detectors S1*a* and S1*b*), and multiple descent start detectors S2 (first and second descent start detectors S2*a* and S2*b*) are provided in accordance with the respective sheet length detectors S4*a* and S4*b*.

Figure 22:
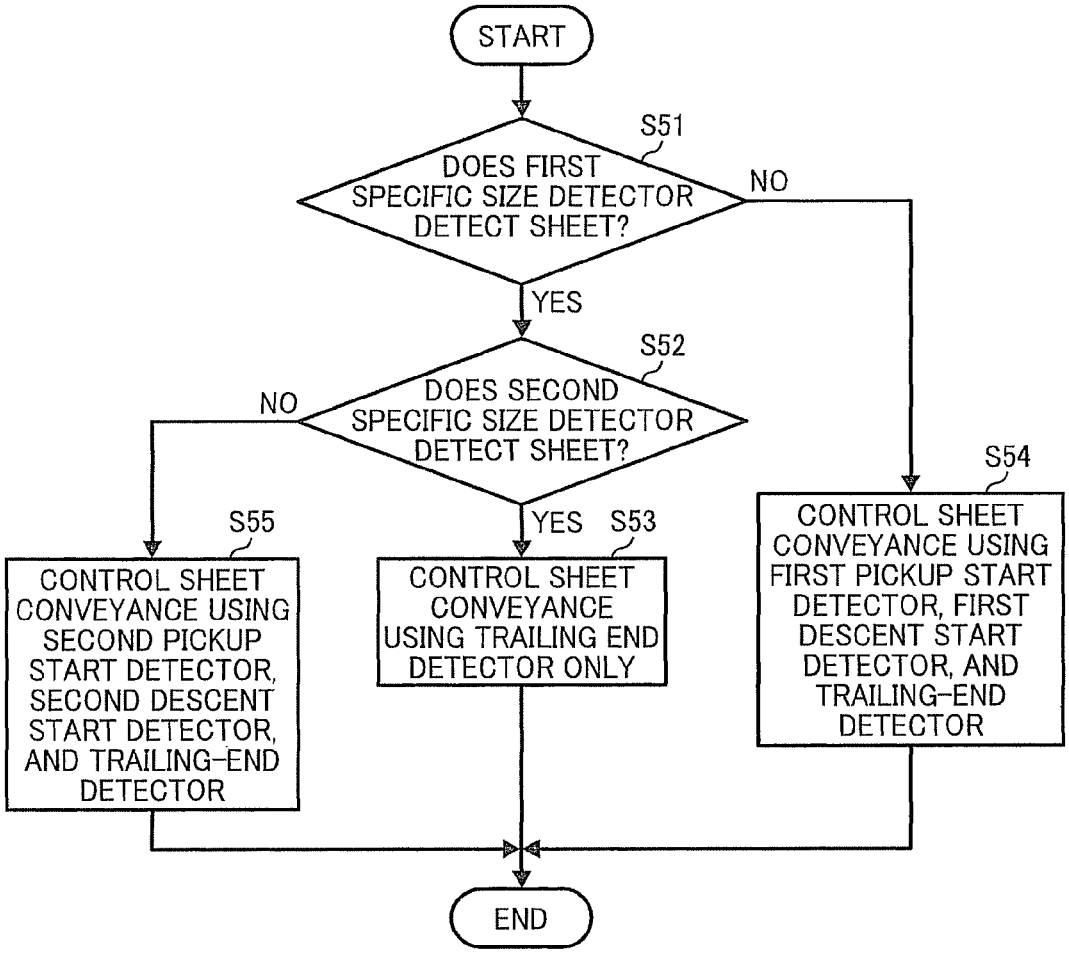
FIG. 22 is a flowchart illustrating a control of conveyance of originals in the configuration shown in FIG. 21.

FIG. 22 is a flowchart illustrating a control flow of conveyance of original documents in the configuration shown in FIG. 21.

Referring to FIGS. 21 and 22, when the first sheet length detector S4*a* does not detect the original document (No at S51), at S54 the controller 100 controls sheet conveyance using the trailing-edge detector S3, the first descent start detector S2*a*, and the first pickup start detector S1*a*. More specifically, the controller 100 monitors the trailing-edge detector S3 and the first descent start detector S2*a*. When the trailing-edge detector S3 detects the trailing end of the original document before the first descent start detector S2*a* detects the leading edge thereof, descending the pickup roller 80 is triggered by the detection result generated by the trailing-edge detector S3. Then, the subsequent sheet is forwarded to the separation nip N1 when the pickup roller 80 contacts the upper side of the bundle of original documents. By contrast, when the first descent start detector S2*a* detects the leading edge of the original document before the trailing-edge detector S3 detects the trailing end thereof, descending the pickup roller 80 is triggered by the detection result by the first descent start detector S2*a*. Simultaneously, the controller 100 monitors the first pickup start detector S1*a* and the trailing-edge detector S3. Then, the subsequent sheet is forwarded to the separation nip N1 when the first pickup start detector S1*a* detects the leading edge of the original document, or the trailing-edge detector S3 detects the trailing end of the original document.

By contrast, when the first sheet length detector S4*a* detects the original document (Yes at S51), at S52 the controller 100 checks whether the second sheet length detector S4*b* detects the original document. When the second sheet length detector S4*b* does not detect the original document (No at S52), at S55 the controller 100 controls sheet conveyance using the trailing-edge detector S3, the second descent start detector S2*b*, and the second pickup start detector S1*b*. More specifically, the controller 100 monitors the trailing-edge detector S3 and the second descent start detector S2*b*. When the trailing-edge detector S3 detects the trailing end of the original document before the second descent start detector S2*b* detects the leading edge thereof, descending the pickup roller 80 is triggered by the detection result generated by the trailing-edge detector S3. Then, the subsequent sheet is forwarded to the separation nip N1 when the pickup roller 80 contacts the upper side of the bundle of original documents. By contrast, when the second descent start detector S2*b* detects the leading edge of the original document before the trailing-edge detector S3 detects the trailing end thereof, descending the pickup roller 80 is triggered by the detection result by the second descent start detector S2*b*. Simultaneously, the controller 100 monitors the second pickup start detector S1*b* and the trailing-edge detector S3. Then, the subsequent sheet is forwarded to the separation nip N1 when the second pickup start detector S1*b* detects the leading edge of the original document, or the trailing-edge detector S3 detects the trailing end of the original document.

In addition, when the second sheet length detector S4*b* detects the original document (Yes at S52), sheet conveyance is controlled using only the trailing-edge detector S3. More specifically, the controller 100 monitors the trailing-edge detector S3 only. When the trailing-edge detector S3 detects the trailing end of the original document, descending the pickup roller 80 is started. Then, the subsequent sheet is forwarded to the separation nip N1 when the pickup roller 80 contacts the upper side of the bundle of original documents.

With the configuration shown in FIG. 21, regarding conveyance of different sheet sizes, intervals between sheets can be reduced to a minimum. Additionally, the sheet length detectors S4*a* and S4*b* may be line sensors. Sheet conveyance can be controlled based on the detection results generated by the sheet length detector S4*a* or S4*b* when the trailing end of the original document is positioned in a range detectable by the first sheet length detector S4*a* or a range detectable by the second sheet length detector S4*b*. More specifically, the controller 100 acquires the number of pulses (threshold Th) corresponding to the detection results generated by the sheet length detector S4*a* or S4*b*, and counts the number of pulses of the driving motor (feed motor 102 and pullout motor 113). When the pulse count reaches the predetermined threshold Th, a sequence of processes from descending the pickup roller 80 to forwarding the subsequent sheet to the separation nip N1 is started.

It is to be noted that, although both the descent start detector S2 and the pickup start detector S1 are used in the present embodiment, alternatively, the pickup start detector S1 may be omitted. In such a case, when the descent start detector S2 detects the leading edge of the original document, the pickup roller 80 is descended. When descending the pickup roller 80 is completed, the feed motor 102 is driven, and thus feeding of the subsequent sheet is started. In this case, the descent start detector S2 is positioned so that the trailing end of the original document of the specific sheet size is positioned at the position shown in FIG. 9 when descending the pickup roller 80 is completed.

By contrast, only the pickup start detector S1 may be used, and control of descending the pickup roller 80 based on the detection by the descent start detector S2 is not performed. In such a case, when the controller 100 deems that the original document is shorter than the specific sheet size in the sheet conveyance direction, for example, descending the pickup roller 80 is started when a predetermined period has elapsed after the pullout motor 113 starts driving. Further, although the pickup roller 80 is moved away from or toward the bundle of original documents for each sheet in the description above, alternatively, such operation may be omitted. In such an ADF in which the pickup roller 80 is not moved away from or toward the bundle of original documents for each sheet, only the pickup start detector S1 is provided. Moreover, the pickup roller 80 may be omitted, and the conveyance belt 84 may have capabilities of sheet conveyance in the separation section and picking up the sheet from the document table 53. In this case, the conveyance belt 84 serves as the second conveyance member, and only the pickup start detector S1 is provided.

It is to be noted that the sheet feeder 40 can have the above-described features of the present specification although they are adopted in the ADF 51 in the above-described embodiment. Applying the above-described features of the present specification to the sheet feeder 40 ca reduce intervals between sheets of recording media on which images are formed, thus increasing the productivity of the image forming apparatus.

As described above, the ADF 51 (sheet conveyance device) according to the present embodiment includes the document table 53 serving as the loading section to accommodate a bundle of original documents (multiple sheets) stacked one on another, the conveyance unit (registration section C and turning section D) to transport the original document to the reading position, the pickup roller 80 serving as the conveyance member to transport the original documents stacked on the document table 53 to the conveyance unit, and the separator (conveyance belt 84 and reverse roller 85) to separate one by one the multiple original documents transported by the pickup roller 80. The ADF 51 further includes the sheet length detector S4 to detect whether the length of the sheet stacked in the loading section is equal to or greater than a predetermined detection length D1 in the sheet conveyance direction, the leading-edge detectors (pickup start detector S1 and descent start detector S2) to detect a leading edge of the sheet at the predetermined position on the sheet conveyance route, the trailing-edge detector S3 to detect a trailing end portion of the sheet at another predetermined position on the sheet conveyance route. When the sheet length detector S4 detects that the length of the sheet stacked in the document table 53 is equal to or greater than the predetermined detection length D1 in the sheet conveyance direction, the controller 100 of the ADF 51 starts feeding the subsequent sheet when the trailing-edge detector S3 detects the trailing edge of the sheet. This control can reduce occurrence of multifeed or skew.

When the sheet length detector S4 detects that the length of the sheet stacked in the document table 53 is shorter than the predetermined detection length D1 in the sheet conveyance direction, the controller 100 starts feeding the subsequent sheet when either the leading-edge detector (descent start detector S2 or pickup start detector S1) detects the leading edge of the sheet (the situation shown in FIGS. 9B), or the trailing-edge detector S3 detects the trailing end portion thereof (the situation shown in FIGS. 10 and 11), which comes first. This control can restrict decreases in productivity in transporting sheets having lengths sufficiently shorter than the specific sheet size in the sheet conveyance direction. Further, this control can increase the productivity in transporting sheets having lengths slightly shorter than the predetermined length in the sheet conveyance direction, detected by the sheet length detector S4.

Additionally, the leading-edge detector is the pickup start detector S1 disposed downstream from the separation nip (separation portion), where the separator separates the sheets, by the sum of the sheet length SL1, detected by the sheet length detector S4, and the margin. The controller 100 causes the pickup roller 80 to start conveyance of the subsequent sheet when the trailing-edge detector S3 detects the trailing end of the original document, or the pickup start detector S1 detects the leading edge thereof. Since the pickup start detector S1 is away from the separation nip by the sum of the sheet length SL1 detected by the sheet length detector S4 and the margin, in conveyance of the sheets of the specific sheet size, multifeed does not occur if sheet conveyance is started when the pickup start detector S1 detects the leading edge thereof. In addition, in the case of sheet sizes shorter or longer than the specific sheet size, occurrence of multifeed and an excessive increase in intervals between sheets can be prevented or restricted by starting feeding the subsequent sheet when the trailing-edge detector detects the trailing end of the original document.

The ADF S1 further includes the roller shifting unit 80A (i.e., cam mechanism) to move the pickup roller 80 away from and toward the bundle of original documents placed on the document table 53. The separation section includes the conveyance belt 84 to transport the original documents and the reverse roller 85 (separator) pressed against the conveyance belt 84, forming the separation nip to separate a single sheet from the multiple original documents. Further, the leading-edge detector is the descent start detector S2 disposed away from the pickup roller 80 by the sum of the sheet length SL1 detected by the sheet length detector S4 and the margin. When the original document is transported by the conveyance belt 84, the controller 100 causes the roller shifting unit 80A to move the pickup roller 80 away from the bundle of original documents. Additionally, when the trailing-edge detector S3 detects the trailing end of the original document, or the descent start detector S2 detects the leading edge thereof, the controller 100 causes the roller shifting unit 80A to start moving the pickup roller 80 toward the bundle of original documents. With this operation, the pickup roller 80 can be prevented from contacting the preceding sheet being transported, thus preventing the occurrence of skew and keeping the sheets clean. Additionally, in the case of the specific sheet size, the pickup roller 80 can start feeding the subsequent sheet immediately after the trailing end of the original document exits from the separation portion. Accordingly, reduction in the productivity caused by descending the pickup roller 80 can be limited.

Further, the controller 100 of the ADF 51 includes a capability of determining defective conveyance. When the sheet length detector S4 detects that the length of the bundle set on the document table 53 is shorter than the predetermined detection length D1 by the sheet size detector S4 and the leading-edge detector (pickup start detector S1 or descent start detector S2) detects the leading edge of the original document before the trailing-edge detector S3 detects the trailing end thereof, the controller 100 deems that the sheet conveyance is defective. When deemed defective, sheet conveyance is stopped. This control can prevent continuation of improper sheet conveyance due to erroneous detection or failure of the sheet length detector S4.

In addition, when the ADF 51 is designed so that the distance L2 from the leading end of the original document on the document table 53 to the separation nip N1 is shorter than the distance L1 from the separation nip N1 to the trailing-edge detector S3, the ADF 51 further includes a mode setter, such as the operation panel 108, to select the mixed-size loading mode for a bundle of sheets having different lengths in the sheet conveyance direction. In the mixed-size loading mode, the sheet length detector S4 detects whether the length of the bundle set on the document table 53 is longer than the predetermined length detected by the sheet size detector S4 in the sheet conveyance direction each time before feeding of the subsequent sheet is started. Further, when the sheet length detector S4 detects that the bundle set on the document table 53 is shorter than the predetermined detection length D1 and the leading-edge detector (pickup start detector S1 or descent start detector S2) detects the leading edge of the original document before the trailing end detector S3 detects the trailing end thereof, feeding of the subsequent sheet is started after the elapse of the sum of the time necessary for the leading edge of the original document placed on the document table 53 to reach the separation nip and the necessary margin from when the leading-edge detector detects the leading edge of the original document.

In addition, the ADF 51 may include, as the leading-edge detectors, both the pickup start detector S1 (first leading-edge detector) and the descent start detector S2 (second leading-edge detector) disposed as described above. When the sheet length detector S4 detects that the length of the bundle set on the document table 53 is shorter than the predetermined detection length D1, the controller 100 causes the roller shifting unit 80A to start moving the pickup roller 80 to contact the bundle when either the descent start detector S2 detects the leading edge of the original document, or the trailing-edge detector S3 detects the trailing end thereof. When the descent start detector S2 detects, the leading edge of the original document before the trailing-edge detector S3 detects the trailing end thereof, sheet conveyance is started when the pickup roller 80 contacts the bundle and one of two requirements, 1) the pickup start detector S1 detects the leading edge of the original document and 2) the trailing-edge detector S3 detects the trailing end thereof, is satisfied. This control can reduce the loss until feeding of the subsequent sheet is started, that is, the time required for the pickup roller 80 to descend to contact the bundle, and intervals between sheets can be adjusted suitably for the length of the original documents in the sheet conveyance direction.

Further, the operation panel 108 can serve as a report unit to report malfunction or failure of the sheet length detector S4 when sheet conveyance is stopped. This can facilitate identification of the cause of troubles.

In addition, the sheet length detector S4 detects whether the bundle set on the document table 53 is longer than the predetermined detection length D1 before the top sheet is transported, and conveyance of subsequent sheets is controlled in accordance with the detection result generated by the sheet length detector S4 before the conveyance of the top sheet is started. This control can prevent defective conveyance even when the sheet length detector S4 erroneously detects that the original document is shorter than the predetermined detection length D1 because the subsequent sheets longer than the predetermined detection length D1 are dragged by the preceding sheet in sequential sheet conveyance.

In addition, the sheet length detectors 57, 58*a*, and 58*b* are disposed upstream from the sheet length detector S4 to detect the length of the bundle, and the length of the bundle is deemed longer than the predetermined detection length D1 when at least one of the sheet length detectors 57, 58*a*, and 58*b* detects the bundle even if the sheet length detector S4 detects that the bundle is shorter than the predetermined length. Thus, even when the original documents have folded marks, the controller 100 can determine correctly whether the original documents are longer than the predetermined length detected by the sheet length detector S4.

Further, the sheet length detector S4 can be a line sensor to detect lengths of original documents whose lengths are within a predetermined range. When the sheet length detector S4 detects the length of the original document on the document table 53, the controller 100 controls conveyance of the subsequent sheet based on the length detected by the sheet length detector S4. In the case of original documents having lengths that the sheet length detector S4 can detect accurately, the trailing-edge detector S3 is not necessary. Instead, counting the time required for sheet conveyance is triggered by the result of the leading end detection, and feeding of the subsequent sheet can be started after the elapse of time required for the trailing end of the original document to exit from the separation nip. Accordingly, regarding original documents having lengths within a predetermined range, intervals between sheets can be reduced to a minimum, enhancing the productivity.

For example, when the sheet length detector S4 detects the length of the original documents on the document table 53, the controller 100 uses the result of the leading end detection as the trigger for starting the count and starts feeding the subsequent sheet when the count reaches the threshold corresponding to the length of the original document. Thus, the feeding of the subsequent sheet can be started after the trailing end of the original document exits from the separation nip.

Moreover, when the line sensor serving as the sheet length detector S4 is disposed with its detection area oblique to the sheet conveyance direction, the sheet length detector S4 can detect whether the width of the original document is within a predetermined range.

In addition, when multiple sheet length detectors S4 are arranged in the sheet conveyance direction, intervals between sheets can be reduced to a minimum in conveyance of original documents of multiple sheet lengths.

Additionally, the image reading unit 50 includes the ADF 51 as the sheet conveyance unit and the reading unit (first and second stationary reading units 151 and 95). Therefore, intervals between original documents to be scanned can be reduced, thus increasing the productivity in sequential image reading.

Additionally, the image forming apparatus 500 includes the image forming unit 1 and the image reading unit 50 including the ADF 51. Therefore, the productivity in sequential image reading can be increased, and the productivity in sequential copying can be increased.

Numerous additional modifications and variations are possible in light of the above teachings. It is therefore to be understood that, within the scope of the appended claims, the disclosure of this patent specification may be practiced otherwise than as specifically described herein.

What is claimed is:

1. A sheet conveyance device comprising:

a loading section to accommodate multiple sheets stacked one on another;

a first conveyance member disposed facing a top sheet of the multiple sheets set in the loading section to apply a transport force to the top sheet of the multiple sheets;

a separation section disposed downstream in a sheet conveyance direction from the first conveyance member to separate at a separation position one by one the multiple sheets transported by the first conveyance member;

a first sheet length detector to detect whether a length of the sheet placed in the loading section is equal to or greater than a predetermined detection length (D1) in the sheet conveyance direction, the predetermined detection length (D1) slightly longer than a specific sheet size in the sheet conveyance direction;

a trailing-edge detector disposed downstream from the separation section in the sheet conveyance direction to detect a trailing edge of the sheet;

a leading-edge detector to detect a leading edge of the sheet, disposed downstream from the trailing-edge detector a distance smaller than the specific sheet size and downstream from the first conveyance member a distance longer than the specific sheet size in the sheet conveyance direction; and a controller to control sheet conveyance in accordance with detection of the first sheet length detector, wherein in a case in which the first sheet length detector detects that the length of the sheet placed in the loading section is equal to or greater than the predetermined detection length (D1) in the sheet conveyance direction, the controller starts feeding a subsequent sheet when the trailing-edge detector detects the trailing edge of a preceding sheet, and in a case in which the first sheet length detector detects that the length of the sheet placed in the loading section is smaller than the predetermined detection length (D1) in the sheet conveyance direction, the controller starts feeding the subsequent sheet when either the leading-edge detector detects the leading edge of the preceding sheet or the trailing-edge detector detects the trailing edge of the preceding sheet.

2. The sheet conveyance device according to claim 1, wherein the leading-edge detector is positioned at a distance equals to a sum of the specific sheet size and a margin in the sheet conveyance direction from the separation position, and the controller causes the first conveyance member to start feeding the subsequent sheet when either the trailing-edge detector detects the trailing edge of the preceding sheet or the leading-edge detector detects the leading edge of the preceding sheet.

3. The sheet conveyance device according to claim 1, further comprising a shifting unit to move the first conveyance member away from and toward the sheet set on the loading section, wherein the separation section comprises a second conveyance member to transport the sheet and a separator pressed against the second conveyance member, together forming a separation nip, the leading-edge detector is disposed downstream from the first conveyance member in the sheet conveyance direction a distance equal to a sum of the specific sheet size and a margin in the sheet conveyance direction, the controller causes the shifting unit to move the first conveyance member away from the sheet placed in the loading section when the preceding sheet is transported by the second conveyance member of the separation section, and the controller causes the shifting unit to move the first conveyance member toward the sheet placed in the loading section when either the trailing-edge detector detects the trailing edge of the preceding sheet or the leading-edge detector detects the leading edge of the preceding sheet.

4. The sheet conveyance device according to claim 1, further comprising a defective conveyance determination unit communicatively connected to the controller to determine whether sheet conveyance is defective, wherein, in a case in which the first sheet length detector detects that the length of the sheet placed in the loading section is smaller than the predetermined detection length (D1) in the sheet conveyance direction, and the leading-edge detector detects the leading edge of the preceding sheet before the trailing-edge detector detects the trailing edge of the preceding sheet, the defective conveyance determination unit checks whether the trailing-edge detector detects the trailing edge of the preceding sheet within a predetermined period of time after the leading-edge detector detects the leading edge thereof, and when the trailing-edge detector does not detect the trailing edge of the preceding sheet within the predetermined period of time, the defective conveyance determination unit deems the sheet conveyance defective, and the controller stops the sheet conveyance.

5. The sheet conveyance device according to claim 1, further comprising a mode setter to select a mixed-size loading mode when a bundle of mixed size sheets different in length in the sheet conveyance direction is placed in the loading section, wherein a distance (L1) from the separation position to the trailing-edge detector is greater than a distance (L2) from the leading edge of the sheet placed in the loading section to the separation position, in the mixed-size loading mode, the first sheet length detector detects whether the sheet placed in the loading section is longer than the predetermined detection length (D1) each time before feeding of the subsequent sheet, is started, in a case in which the first sheet length detector detects that the length of the sheet placed in the loading section is smaller than the predetermined detection length (D1) in the sheet conveyance direction, and the leading-edge detector detects the leading edge of the preceding sheet before the trailing-edge detector detects the trailing edge of the preceding sheet, the controller checks whether a waiting time that is a sum of time required for the leading edge of the sheet placed in the loading section to reach the separation position and a margin has elapsed after the leading-edge detector detects the leading edge of the preceding sheet, and the controller starts feeding the subsequent sheet when either the waiting time has elapsed or the trailing-edge detector detects the trailing edge of the preceding sheet before the waiting time has elapsed.

6. The sheet conveyance device according to claim 1, wherein the first sheet length detector detects whether the length of the sheet placed in the loading section is equal to or greater than the predetermined detection length (D1) in the sheet conveyance direction before feeding the top sheet of the multiple sheets placed in the loading section is started, and conveyance of subsequent sheets is controlled in accordance with a detection result generated by the first sheet length detector before conveyance of the top sheet is started.

7. The sheet conveyance device according to claim 1, further comprising a sheet detector disposed upstream from the first sheet length detector in the sheet conveyance direction to detect the sheet placed in the loading section, wherein, when the sheet detector detects the sheet, the controller deems that the sheet placed in the loading section is longer than the predetermined detection length (D1) even when the first sheet length detector does not detect the sheet.

8. The sheet conveyance device according to claim 1, wherein the first sheet length detector detects a length of sheets having a predetermined range in the sheet conveyance direction, and when the first sheet length detector detects the length of the sheet placed in the loading section, the controller controls conveyance of the subsequent sheet based on the length of the sheet detected by the first sheet length detector.

9. The sheet conveyance device according to claim 8, wherein, when the first sheet length detector detects the length of the sheet placed in the loading section, the controller starts counting, triggered by detection of the leading edge of the sheet by the leading end detector, and conveyance of the subsequent sheet is started when the count reaches a threshold corresponding to the length of the sheet detected.

10. The sheet conveyance device according to claim 8, wherein a detection range of the first sheet length detector is oblique to the sheet conveyance direction.

11. A sheet conveyance device comprising:

a loading section to accommodate multiple sheets stacked one on another;

a first conveyance member disposed facing a top sheet of the multiple sheets set in the loading section, to apply a transport force to the top sheet of the multiple sheets;

a separation section disposed downstream in a sheet conveyance direction from the first conveyance member to separate at a separation position one by one the multiple sheets transported by the first conveyance member;

a shifting unit to move the first conveyance member away from and toward the sheet set in the loading section;

a first sheet length detector to detect whether the length of the sheet placed in the loading section is equal to or greater than a predetermined detection length (D1) in the sheet conveyance direction, the predetermined detection length (D1) slightly longer than a specific sheet size in the sheet conveyance direction;

a trailing-edge detector disposed downstream from the separation section in the sheet conveyance direction to detect a trailing edge of the sheet;

a first leading-edge detector and a second leading-edge detector to detect a leading edge of the sheet disposed downstream from the trailing-edge detector in the sheet conveyance, the first leading-edge detector disposed downstream from the separation position in the sheet conveyance direction a distance equal to a sum of the specific sheet size and a margin;

the second leading-edge detector disposed downstream from the first conveyance member in the sheet conveyance direction a distance equal to a sum of the specific sheet size and a margin; and a controller to control sheet conveyance in accordance with detection by the first sheet length detector, wherein, in a case in which the first sheet length detector detects that the length of the sheet placed in the loading section is equal to or greater than the predetermined detection length (D1) in the sheet conveyance direction, the controller starts feeding a subsequent sheet when the trailing-edge detector detects the trailing edge of a preceding sheet, in a case in which the first sheet length detector detects that the length of the sheet placed in the loading section is smaller than the predetermined detection length (D1) in the sheet conveyance direction, the controller starts the shifting unit to move the first conveyance member toward the sheet placed in the loading section when either the second leading-edge detector detects the leading edge of the preceding sheet or the trailing-edge detector detects the trailing edge of the preceding sheet, in a case in which the second leading-edge detector detects the leading edge of the preceding sheet before the trailing-edge detector detects the trailing edge of the preceding sheet, the controller causes the first conveyance member to start feeding the subsequent sheet when the first conveyance member contacts the sheet placed in the loading section and the first leading-edge detector detects the leading edge of the sheet, or when the first conveyance member contacts the sheet placed in the loading section and the trailing-edge detector detects the trailing edge of the preceding sheet, and in a case in which the trailing-edge detector detects the trailing edge of the preceding sheet before the second leading-edge detector detects the leading edge of the preceding sheet, the controller causes the first conveyance member to start feeding the subsequent sheet when the first conveyance member contacts the sheet placed in the loading section.

12. The sheet conveyance device according to claim 11, further comprising a defective conveyance determination unit to determine whether sheet conveyance is defective.

13. The sheet conveyance device according to claim 12, wherein, when the first sheet length detector detects that the length of the sheet placed in the loading section is smaller than the predetermined detection length (D1) in the sheet conveyance direction, and the second the leading-edge detector detects the leading edge of the preceding sheet before the trailing-edge detector detects the trailing edge of the preceding sheet, the defective conveyance determination unit checks whether the trailing-edge detector detects the trailing edge of the preceding sheet in a first predetermined period after the second leading-edge detector detects the leading edge thereof, and when the trailing-edge detector does not detect the trailing edge of the preceding sheet in the first predetermined period, the defective conveyance determination unit deems the sheet conveyance defective, and the controller stops the sheet conveyance.

14. The sheet conveyance device according to claim 12, wherein, when the first sheet length detector detects that the length of the sheet placed in the loading section is smaller than the predetermined detection length in the sheet conveyance direction, and the first leading-edge detector detects the leading edge of the preceding sheet before the trailing-edge detector detects the trailing edge of the preceding sheet, the defective conveyance determination unit checks whether the trailing-edge detector detects the trailing edge of the preceding sheet in a second predetermined period after the first leading-edge detector detects the leading edge thereof, and when the trailing-edge detector does not detect the trailing edge of the preceding sheet within the second predetermined period, the defective conveyance determination unit deems the sheet conveyance defective, and the controller stops the sheet conveyance.

15. The sheet conveyance device according to claim 12, further comprising a reporting unit to report that the first sheet length detector is defective when the sheet conveyance is stopped due to the defective conveyance.

16. The sheet conveyance device according to claim 11, further comprising a mode setter to select a mixed-size loading mode when a bundle of mixed size sheets different in length in the sheet conveyance direction is placed in the loading section, wherein a distance (L1) from the separation position to the trailing-edge detector is greater than a distance (L2) from the leading edge of the sheet placed in the loading section to the separation position, in the mixed-size loading mode, the first sheet length detector detects whether the sheet placed in the loading section is longer than the predetermined detection length (D1) each time before feeding of the subsequent sheet is started, in a case in which the first sheet length detector detects that the length of the sheet placed in the loading section is smaller than the predetermined detection length (D1) in the sheet conveyance direction, and the second leading-edge detector detects the leading edge of the preceding sheet before the trailing-edge detector detects the trailing edge of the preceding sheet, the controller checks whether a first waiting time has elapsed, the first waiting time equal to a sum of time required for the leading edge of the sheet placed in the loading section to reach the separation position after the second leading-edge detector detects the leading edge of the preceding sheet and a margin, when either the first waiting time has elapsed or the trailing-edge detector detects the trailing edge of the preceding sheet before the first waiting time has elapsed, the controller starts the shifting unit to move the first conveyance member toward the sheet placed in the loading section, in a case in which the first leading-edge detector detects the leading edge of the preceding sheet before the trailing-edge detector detects the trailing edge of the preceding sheet, the controller checks whether a fourth predetermined period has elapsed, the second waiting time equal to a sum of time required for the leading edge of the sheet placed in the loading section to reach the separation position after the first leading-edge detector detects the leading edge of the preceding sheet and a margin, and the controller starts feeding the subsequent sheet when the first conveyance member contacts the sheet placed in the loading section and the second waiting time has elapsed, or when the first conveyance member contacts the sheet placed in the loading section and the trailing-edge detector detects the trailing edge of the preceding sheet before the second waiting time has elapsed.

17. The sheet conveyance device according to claim 11, wherein the first sheet length detector detects whether the length of the sheet placed in the loading section is equal to or greater than the predetermined detection length (D1) in the sheet conveyance direction before feeding of the top sheet of the multiple sheets placed in the loading section is started, and conveyance of subsequent sheets is controlled in accordance with a detection result by the first sheet length detector generated before conveyance of the top sheet is started.

18. The sheet conveyance device according to claim 11, further comprising a second sheet length detector to detect whether the length of the sheet placed in the loading section is equal to or greater than a sheet length different from the predetermined detection length detected by the first sheet length detector, wherein the first sheet length detector and the second sheet detector are arranged at different positions in the sheet conveyance direction.

19. An image reading device comprising:

a reading unit to read image data of an original document; and a sheet conveyance device to transport the original document to a reading position of the reading unit, the sheet conveyance device comprising:

a loading section to accommodate multiple sheets of original documents stacked one on another;

a first conveyance member disposed facing a top sheet of the multiple original documents set in the loading section, to apply a transport force to the top sheet of the multiple original documents;

a separation section disposed downstream in a sheet conveyance direction from the first conveyance member to separate at a separation position one by one the multiple original documents transported by the first conveyance member;

a first sheet length detector to detect whether a length of the original document placed in the loading section is equal to or greater than a predetermined detection length (D1) in the sheet conveyance direction, the predetermined detection length (D1) slightly longer that a specific sheet size in the sheet conveyance direction;

a trailing-edge detector disposed downstream from the separation section in the sheet conveyance direction to detect a trailing edge of the original document;

a first leading-edge detector to detect a leading edge of the original document, disposed downstream from the trailing-edge detector a first distance smaller than the specific sheet size and downstream from the first conveyance member a distance longer than the specific sheet size in the sheet conveyance direction; and a controller to control sheet conveyance in accordance with detection of the first sheet length detector, wherein in a case in which the first sheet length detector detects that the length of the original document placed in the loading section is equal to or greater than the predetermined detection length (D1) in the sheet conveyance direction, the controller starts feeding a subsequent sheet when the trailing-edge detector detects the trailing edge of a preceding sheet, and in a case in which the first sheet length detector detects that the length of the original document placed in the loading section is smaller than the predetermined detection length (D1) in the sheet conveyance direction, the controller starts feeding the subsequent sheet when the first leading-edge detector detects the leading edge of the preceding sheet, or when the trailing-edge detector detects the trailing edge of the preceding sheet.

20. An image forming apparatus comprising:

the image reading device according to claim 19; and an image forming unit to form an image according to the image data ready by the image reading device.

* * * * *